US007148851B2

(12) United States Patent
Takaki et al.

(10) Patent No.: US 7,148,851 B2
(45) Date of Patent: Dec. 12, 2006

(54) ANTENNA DEVICE AND COMMUNICATIONS APPARATUS COMPRISING SAME

(75) Inventors: Yasunori Takaki, Kumagaya (JP); Hiroyuki Aoyama, Kumagaya (JP)

(73) Assignee: Hitachi Metals, Ltd., Tokyo (JP)

( * ) Notice: Subject to any disclaimer, the term of this patent is extended or adjusted under 35 U.S.C. 154(b) by 20 days.

(21) Appl. No.: 10/912,282

(22) Filed: Aug. 6, 2004

(65) Prior Publication Data

US 2005/0078038 A1 Apr. 14, 2005

(30) Foreign Application Priority Data

Aug. 8, 2003 (JP) ..... 2003-290581

(51) Int. Cl.
*H01Q 1/24* (2006.01)

(52) U.S. Cl. ..... 343/702; 343/700 MS

(58) Field of Classification Search ..... 343/700 MS, 343/702, 846

See application file for complete search history.

(56) References Cited

U.S. PATENT DOCUMENTS 5,696,517 A * 12/1997 Kawahata et al. ... 343/700 MS
5,909,198 A 6/1999 Mandai et al.
5,973,651 A * 10/1999 Suesada et al. ..... 343/752
6,016,126 A 1/2000 Holshouser
6,288,680 B1 9/2001 Tsuru et al.
6,320,545 B1 * 11/2001 Nagumo et al. ..... 343/700 MS
7,061,434 B1 * 6/2006 Aoyama et al. ..... 343/702

FOREIGN PATENT DOCUMENTS

| | | |
|---|---|---|
| EP | 0 863 571 A2 | 9/1998 |
| EP | 0 944 128 A1 | 9/1999 |
| JP | 09-139621 | 5/1997 |
| JP | 10-178312 | 6/1998 |
| JP | 11-004117 | 1/1999 |
| JP | 2001-274719 | 10/2001 |
| JP | 2002-111344 | 4/2002 |
| JP | 2002-111349 | 4/2002 |
| JP | 2003-158410 | 5/2003 |

* cited by examiner

*Primary Examiner*—Tho Phan
(74) *Attorney, Agent, or Firm*—Finnegan, Henderson, Farabow, Garrett, and Dunner, LLP

(57) ABSTRACT

An antenna device comprising (a) a mounting substrate having a ground portion and a non-ground portion, (b) a chip antenna mounted onto said non-ground portion, which comprises a substrate, a first radiation electrode formed on said substrate, a power-supplying electrode connected or not connected to the other end of said first radiation electrode, and a terminal electrode connected or not connected to one end of said first radiation electrode, and (c) at least one second radiation electrode formed in a conductor pattern on said non-ground portion, said second radiation electrode having one end connected or not connected to said terminal electrode and the other end which is an open end, and a cavity existing between said chip antenna and/or said second radiation electrode and said ground portion.

20 Claims, 22 Drawing Sheets

ANTENNA DEVICE AND COMMUNICATIONS APPARATUS COMPRISING SAME

FIELD OF THE INVENTION

The present invention relates to an antenna device used in mobile phones, wireless local area networks (LANs), etc., particularly to a small, wide-bandwidth antenna device adaptable to multi-bands such as dual-band and triple-band, and a communications apparatus comprising such an antenna.

BACKGROUND OF THE INVENTION

The demand of miniaturization on communications apparatus and electronic apparatuses such as mobile phones and personal computers necessitates the miniaturization of antenna devices used therein. Thus, chip antennas comprising power-supplying electrodes and radiation electrodes on or in base substrates made of dielectric or magnetic materials have become used.

There are various systems for mobile phones, for instance, EGSM (extended global system for mobile communications) and DCS (digital cellular system) widely used mostly in Europe, PCS (personal communications services) used in the U.S., and various systems using TDMA (time division multiple access) such as PDC (personal digital cellular) used in Japan. According to recent rapid expansion of mobile phones, however, a frequency band allocated to each system cannot allow all users to use their mobile phones in major cities in advanced countries, resulting in difficulty in connection and thus causing such a problem that mobile phones are sometimes disconnected during communication. Thus, proposal was made to permit users to utilize a plurality of systems, thereby increasing substantially usable frequency, and further to expand serviceable territories and to effectively use communications infrastructure of each system.

Accordingly, multi-band systems utilizing two or more frequency bands with one antenna are increasingly demanded. For instance, according to the needs of making mobile phones multi-functional, demand is mounting on small multi-band antenna devices, such as small dual-band antenna devices for handling a cellular system (for instance, transmission frequency: 824 to 849 MHz, receiving frequency: 869 to 894 MHz, though it depends on countries), a system for oral communications, and a global positioning system GPS (center frequency: 1575 MHz) having a position-detecting function, or small triple-band antenna devices for handling an EGSM system (transmission frequency: 880 to 915 MHz, receiving frequency: 925 to 960 MHz), a DCS system (transmission frequency: 1710 to 1785 MHz, receiving frequency: 1805 to 1880 MHz) and a PCS system (transmission frequency: 1850 to 1910 MHz, receiving frequency: 1930 to 1990 MHz).

As shown in FIG. 23, conventionally produced is a dual-band antenna device having two chip antennas disposed in parallel each comprising two radiation electrodes corresponding to two resonance frequencies (see, for instance, JP 11-4117 A). In FIG. 23, the antenna device 90 comprises a substrate 91, two chip antennas 93*a*, 93*b* mounted onto a surface 92*a* of the substrate 91, and a power-supplying electrode 94 and a ground electrode 95 formed on the surface 92*a* of the substrate 91. The ground electrode 95 and the two chip antenna 93*a*, 93*b* are close to each other. The power-supplying electrode 94 has one end divided to two, each connected to each power-supplying electrode 96*a*, 96*b* of each chip antennas 93*a*, 93*b*, and the other end connected to a high-frequency signal source (not shown). The other end of each of the first and second radiation electrodes 97*a*, 97*b* formed on the substrates of the chip antennas 93*a*, 93*b* is an open end.

However, the antenna device of JP 11-4117 A is not suitable for sufficient miniaturization because it comprises two chip antennas in a shape of rectangular parallelepiped. Though it has been proposed to mount a chip antenna 93*b* on a rear surface 92*b* of the substrate 91 for miniaturization, it does not meet the demand of thinning, because the thickness of a mounting substrate hinders such demand. Further, the increase of an opposing area between the ground electrode 95 and the chip antenna 93*a* results in increase in electrostatic capacitance and thus decrease in bandwidth. Thus, the antenna device of JP 11-4117 A fails to satisfy the demands of miniaturization, space reduction and bandwidth increase.

U.S. Pat. No. 6,288,680 discloses a antenna device comprising a chip antenna comprising a radiation electrode formed on a substrate, a power-supplying electrode connected to one end of the radiation electrode, a terminal electrode connected to the other end of the radiation electrode, and a mounting substrate having this chip antenna mounted thereonto, on whose surface a radiation electrode is formed. Because of the connection of the radiation electrode of the chip antenna to the radiation electrode on the mounting substrate, this antenna device has a large effective length of a conductor and a strong radiation electric field, thereby achieving a high gain and a wide bandwidth.

The antenna device disclosed in JP 2001-274719 A comprises a chip antenna mounted onto a mounting substrate, and a notch-shaped slit in a ground portion between the chip antenna and an adjacent high-frequency circuit. The notch slit suppresses a high-frequency current from flowing from the chip antenna to the high-frequency circuit, improving radiation characteristics.

However, the conventional antenna devices are disadvantageous in failing to meet all of the requirements of miniaturization, space reduction and bandwidth increase. Though U.S. Pat. No. 6,288,680 proposes the bandwidth increase, it simply suppresses the deterioration of bandwidth in a low frequency band, failing to handle a multi-band system. The gain increase by the notch slit as in JP 2001-274719 A only limits a path of a high-frequency current flowing in the ground electrode, failing to provide the bandwidth increase and to make the system adaptable for multi-band.

When pluralities of radiation electrodes are formed in the conventional antenna substrate to make the system adaptable for multi-band, it is difficult to keep isolation because of electrostatic capacitance generated between the radiation electrodes. Specifically, the higher the electrostatic capacitance between the radiation electrodes, the more the high-frequency current flows in the radiation electrodes in opposite directions, so that the radiation electrodes weaken the radiation of an electromagnetic wave each other, resulting in decrease in the gain (sensitivity). Though a wide band and a high gain are desirable in pluralities of frequency bands in multi-band antenna devices, JP 11-4117 A and U.S. Pat. No. 6,288,680 fail to provide any discussion on such points.

Much attention is recently paid to the reduction of influence of electromagnetic waves radiated from mobile phones, etc. on human bodies (heads) for health, and therefore antenna devices having low specific absorption rates (SAR) of electromagnetic waves are desired.

OBJECTS OF THE INVENTION

Accordingly, an object of the present invention is to provide a small antenna device capable of being adapted to multi-band systems, which avoids gain decrease by securing isolation in pluralities of frequency bands, and which has a wide bandwidth and a high average gain in each frequency band.

Another object of the present invention is to provide a communications apparatus comprising such an antenna device.

DISCLOSURE OF THE INVENTION

The first antenna device of the present invention comprises (a) a mounting substrate having a ground portion and a non-ground portion, (b) a chip antenna mounted onto the non-ground portion, which comprises a substrate, a first radiation electrode formed on the substrate, a power-supplying electrode connected or not connected to the other end of the first radiation electrode, and a terminal electrode connected or not connected to one end of the first radiation electrode, and (c) at least one second radiation electrode formed in a conductor pattern on the non-ground portion, the second radiation electrode having one end connected or not connected to the terminal electrode and the other end which is an open end, and a cavity existing between the chip antenna and/or the second radiation electrode and the ground portion.

The second antenna device of the present invention comprises (a) a mounting substrate having a ground portion and a non-ground portion, (b) a chip antenna mounted onto a non-ground portion on a front surface of the mounting substrate, which comprises a substrate, a first radiation electrode formed on the substrate, a power-supplying electrode connected or not connected to the other end of the first radiation electrode, and a terminal electrode connected or not connected to the other end of the first radiation electrode, and (c) a second radiation electrode formed in a conductor pattern on a non-ground portion, which is an opposing surface of the chip-antenna-carrying surface of the mounting substrate, the second radiation electrode being connected or not connected to the terminal electrode, with its other end being an open end, and a cavity existing between the chip antenna and/or the second radiation electrode and the ground portion.

The third antenna device of the present invention comprises (a) a mounting substrate having a ground portion and a non-ground portion, (b) a sub-substrate fixed to the mounting substrate with space, (c) a chip antenna mounted onto the sub-substrate, which comprises a substrate, a first radiation electrode formed on the substrate, a power-supplying electrode connected or not connected to the other end of the first radiation electrode, and a terminal electrode connected or not connected to the other end of the first radiation electrode, and (d) a second radiation electrode formed in a conductor pattern on the chip-antenna-carrying surface of the sub-substrate or its opposing surface, the second radiation electrode being connected or not connected to the terminal electrode, with its other end being an open end, and a cavity existing between the chip antenna and/or the second radiation electrode and the ground portion of the mounting substrate.

The communications apparatus of the present invention such as a mobile phone comprises any one of the above antenna devices.

BRIEF DESCRIPTION OF THE DRAWINGS

FIG. 2(*b*) is a partial plan view showing one example of the antenna device of the present invention when viewed from the opposing surface of the chip-antenna-carrying surface (rear surface);

FIG. 3(*b*) is a perspective view showing another example of the chip antenna used in the antenna device of the present invention;

FIG. 3(*c*) is a perspective view showing a further example of the chip antenna used in the antenna device of the present invention;

FIG. 6(*b*) is a partial plan view showing a further example of the antenna device of the present invention having pluralities of round holes as a cavity;

FIG. 7(*b*) is a partial bottom view showing a still further example of the antenna device of the present invention;

FIG. 8(*b*) is a partial bottom view showing a still further example of the antenna device of the present invention;

FIG. 9(*b*) is a partial bottom view showing a still further example of the antenna device of the present invention;

FIG. 10(*b*) is a partial bottom view showing a still further example of the antenna device of the present invention;

FIG. 11(*b*) is a partial bottom view showing a still further example of the antenna device of the present invention;

FIG. 14(*b*) is a partial bottom view of the antenna device of FIG. 14(*a*);

FIG. 15(*b*) is a partial bottom view of the antenna device of FIG. 15(*a*);

FIG. 16(*b*) is a plan view showing a chip antenna mounted onto the sub-substrate in the antenna device of FIG. 16(*a*);

FIG. 16(*c*) is a partially cross-sectional right side view showing the antenna device of FIG. 16(*a*);

FIG. 17(*b*) is a graph showing the relation between a frequency and VSWR in the antenna device in Comparative Example 2;

FIG. 18(*b*) is a graph showing the relation between a frequency and an average gain in the antenna device in Comparative Example 2;

FIG. 22(*b*) is a block diagram showing another example of the antenna device of the present invention.

BEST MODE FOR CARRYING OUT THE INVENTION

Figure 1:
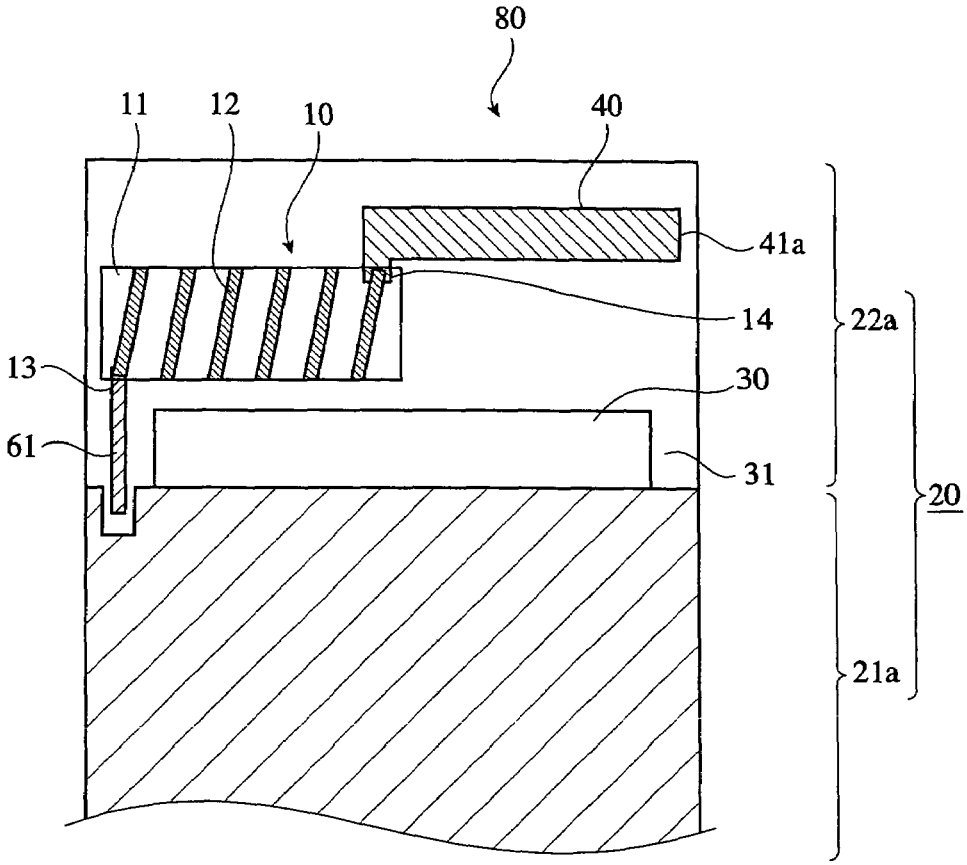
FIG. 1 is a partial plan view showing one example of the antenna device of the present invention.
Figure 9A:
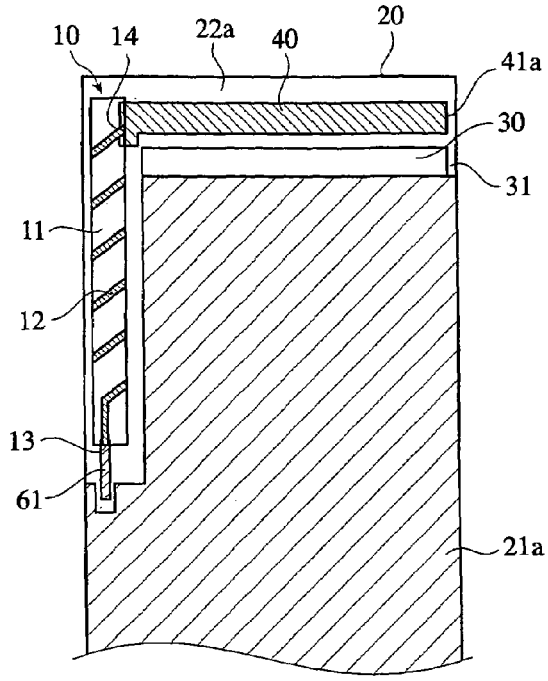
FIG. 9(*a*) is a partial top view showing a still further example of the antenna device of the present invention.
Figure 9B:
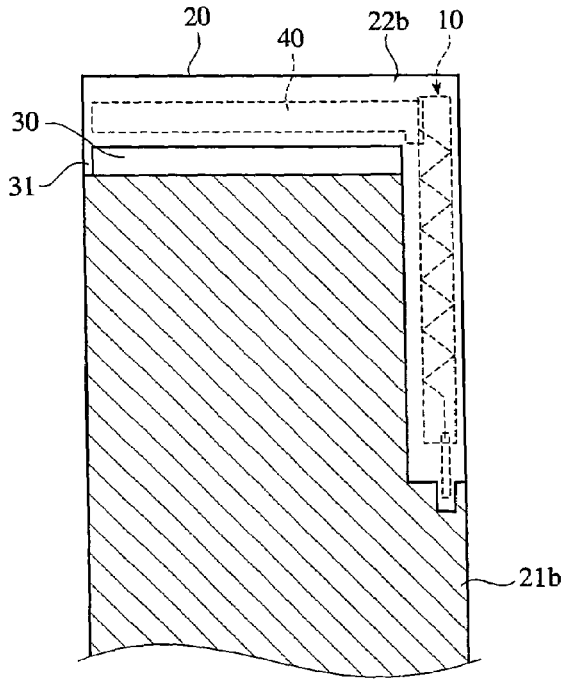

The antenna device 80 according to a preferred embodiment of the present invention comprises, as shown in FIGS. 1 and 9, a mounting substrate 20 having a ground portion 21 and a non-ground portion 22; a chip antenna 10 mounted onto the non-ground portion 22*a*, which comprises a substrate 11, a first radiation electrode 12 formed on the substrate 11, a power-supplying electrode 13 connected to the other end of the first radiation electrode 12, and a terminal electrode 14 connected or not connected to one end of the first radiation electrode 12; and a second radiation electrode 40 formed in a conductor pattern on the non-ground portion 22*a*; the second radiation electrode 40 being connected or not connected to the terminal electrode 14 and having an open end 41*a* at the other end; and a hollow groove 30 existing between the second radiation electrode 40 and/or the chip antenna 10 and the ground portion 21*a* of the mounting substrate 20. Though the ground portion 21 usually comprises a surface ground portion 21*a* and a rear surface ground portion 21*b*, it may be formed only on one surface. The non-ground portion 22 comprises a front non-ground portion 22*a* and a rear non-ground portion 22*b*.

The antenna device 80 according to another embodiment of the present invention comprises, as shown in FIGS. 8, 10, 11, 14 and 15, a mounting substrate 20 comprising a ground portion 21 and a non-ground portion 22 (22*a*, 22*b*); a chip antenna 10 mounted onto the non-ground portion 22*a* on the surface of the mounting substrate 20, which comprises a substrate 11, a first radiation electrode 12 formed on the substrate 11, a power-supplying electrode 13 connected to the other end of the first radiation electrode 12, and a terminal electrode 14 connected or not connected to one end of the first radiation electrode 12; and a second radiation electrode 40 formed in a conductor pattern on the non-ground portion 22*b* on the opposing surface of the chip-antenna-carrying surface of the mounting substrate 20; the second radiation electrode 40 being connected or not connected to the terminal electrode 14 and having an open end 41*a* at the other end; and a hollow groove 30 existing between the second radiation electrode 40 and/or the chip antenna 10 and the ground portion 21 of the mounting substrate 20.

Figure 16A:
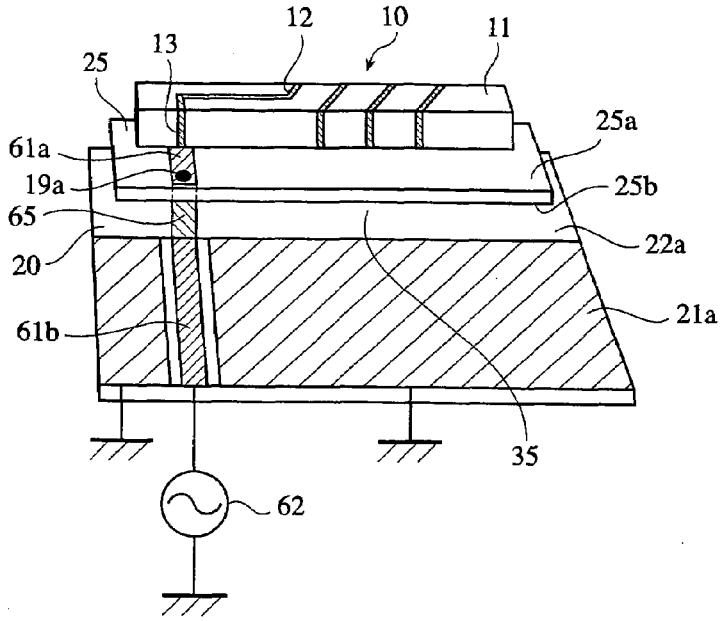
FIG. 16(*a*) is a perspective view showing a still further example of the antenna device of the present invention.
Figure 16B:
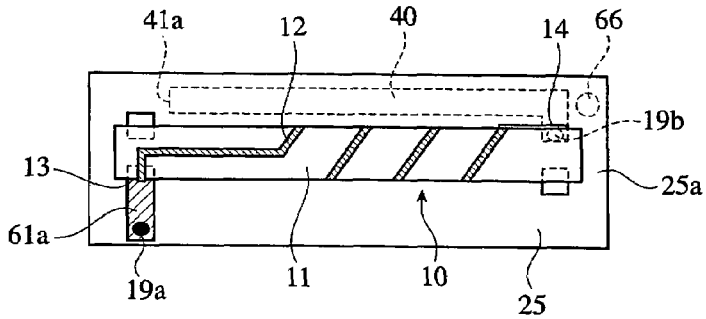
Figure 16C:
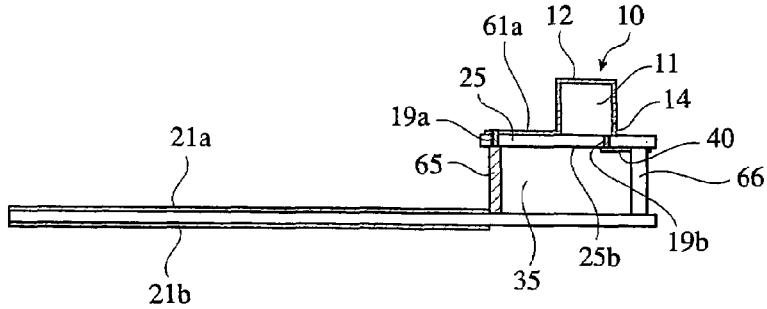

The antenna device according to a further embodiment of the present invention comprises, as shown in FIG. 16, a mounting substrate 20 comprising a ground portion 21*a* and a non-ground portion 22*a*; a sub-substrate 25 fixed to the mounting substrate 20 with space; a chip antenna 10 mounted onto the sub-substrate 25, which comprises a substrate 11, a first radiation electrode 12 formed on the substrate 11, a power-supplying electrode 13 connected to the other end of the first radiation electrode 12, and a terminal electrode 14 connected or not connected to one end of the first radiation electrode 12; and a second radiation electrode 40 formed in a conductor pattern on a non-ground portion 25*a* on an antenna-mounting surface of the sub-substrate 25 or on a non-ground portion 25*b* on an opposing surface of the antenna-mounting surface; the second radiation electrode 40 being connected or not connected to the terminal electrode 14 and having an open end 41*a* at the other end; and a cavity 35 existing between the second radiation electrode 40 and/or the chip antenna 10 and the ground portion 21 of the mounting substrate 20.

When the chip-antenna-carrying surface is opposing a second-radiation-electrode-bearing surface, the terminal electrode on the chip antenna mounted onto the mounting substrate is connected to the second radiation electrode preferably via a through-hole for miniaturization and the stabilization of characteristics.

When the chip antenna mounted onto the mounting substrate and the second radiation electrode formed on the opposing surface of the chip-antenna-carrying surface of the mounting substrate are disposed such that they are not overlapping with each other when viewed from above, the bandwidth of the antenna device is preferably made wider. On the contrary, when they are disposed such that they are overlapping with each other, the antenna device has a lowered center frequency, which can be utilized for frequency adjustment.

For the miniaturization of the antenna substrate, a remaining portion of the substrate after the formation of the hollow groove is desirably on the open-end side of the second radiation electrode.

The other end of the first radiation electrode may not be connected to the power-supplying electrode.

As shown in FIGS. 1 and 9, the second radiation electrode 40 may extend toward the extension direction of the first radiation electrode 12 such that its open end 41 a is distant from the power-supplying electrode 13 of the chip antenna 10. Because a wide band is achieved in this case though it has only one resonance mode, it is suitable for a single-band antenna device, or a dual-band antenna device covering pluralities of relatively close frequency bands (for instance, frequency bands of DCS and PCS).

As shown in FIGS. 8, 10, 11, 14 and 16, the second radiation electrode 40 may extend in an opposite direction from the terminal electrode 14, such that its open end 41*b* is close to the power-supplying electrode 13 of the chip antenna 10. When the second radiation electrode extends in both directions from the terminal electrode 14, it has two resonance modes, suitable for dual-band antenna devices covering two separate frequency bands (for instance, cellular and GPS), or triple-band antenna devices covering EGSM, DCS and PCS.

Though the second radiation electrode is formed on the opposing surface of the chip-antenna-carrying surface, the opposing surface is not restricted to the rear surface of the substrate. For instance, when the mounting substrate is a laminate substrate having an intermediate layer provided with the second radiation electrode, and another layer provided with a third or fourth radiation electrode, it is adapted for multi-band antenna devices of dual-band or more. Thus, the second et seq. radiation electrodes may be formed on the opposing surface of the chip-antenna-carrying surface, namely, on the rear surface of the mounting substrate, and the intermediate layer of the multi-layer substrate.

Figure 6A:
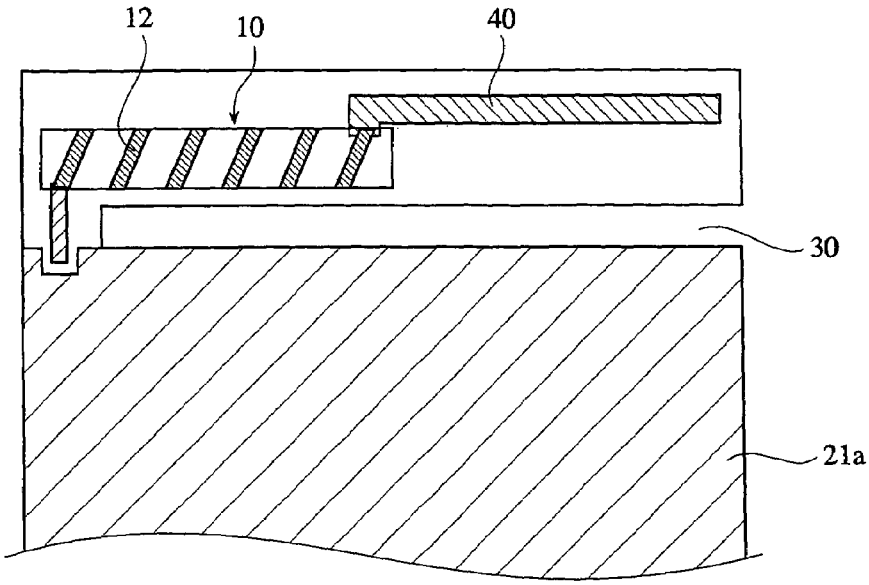
FIG. 6(*a*) is a partial plan view showing another example of the antenna device of the present invention, which comprises a notch as a cavity.
Figure 6B:
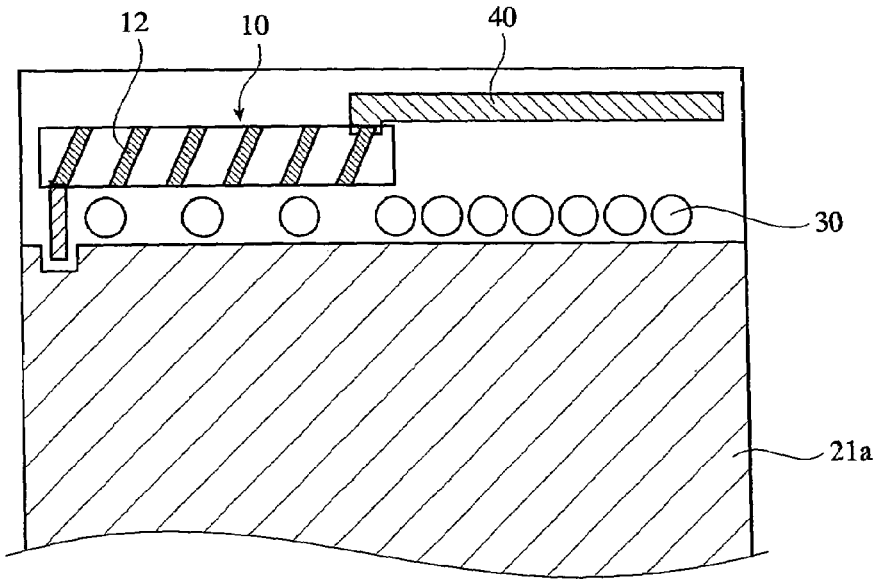

The cavity may be a hollow groove formed in the substrate, space between separate substrates fixed to each other, etc. The hollow groove 30 is a penetrating hole such as a slot, a notch slit, etc. formed in the mounting substrate 20. In FIG. 1, for instance, the hollow groove 30 is a slot formed in the mounting substrate 20, with remaining portions 31 on both sides. FIG. 6(*a*) shows an example in which the hollow groove 30 is a notch extending to the end of the mounting substrate 20, FIG. 6(*b*) shows an example in which pluralities of round holes are formed between the chip antenna 10 and the second radiation electrode 40 and the ground portion 21*a* on the chip-antenna-carrying surface. Though a non-penetrating hollow groove may be used in the present invention, the penetrating hole provides a larger effect on expanding the bandwidth. The notch slit is undesirably likely to prevent the remaining portion from existing on the open end side of the second radiation electrode. A region having the cavity is between the chip antenna and the second radiation electrode and the ground portion, preferably at least between the second radiation electrode and the ground portion.

For bandwidth increase, it is important that there is large distance between the chip antenna and/or the second radiation electrode and the ground portion of the mounting substrate (the ground portion formed on the chip-antenna-carrying surface, and/or the ground portion formed on the opposite side (rear surface) of the chip-antenna-carrying surface). It has been found that increase in the bandwidth and the gain can be achieved not only by increasing that distance but also by providing the hollow groove. Because a Q value is governed by electrostatic capacitance generated between the first and second radiation electrodes and the ground electrode of the mounting substrate, particularly by electrostatic capacitance generated between the second radiation electrode and the ground electrode among LC resonance circuits comprising capacitance components between the radiation electrode and the ground electrode, it has been found that the formation of a cavity (hollow groove) having a dielectric constant and a permeability both equal to 1 between them results in the reduction of predominant coupling and thus the reduction of the Q value. It has also been found that the width of the hollow groove is 1/20 or less of wavelength $\lambda$ of the resonance frequency, particularly about 1/10 or less in high-frequency bands, and generally 3 to 5 mm.

With respect to the miniaturization of the antenna device, it is effective to provide the remaining portion between the open end of the second radiation electrode and the ground portion. The remaining portion makes it easy to generate capacitance between the open end of the second radiation electrode and the ground portion, resulting in the size reduction of the radiation electrode, and thus the miniaturization of the antenna device. This is also an important feature of the present invention. It has also been found that the hollow groove is effective for improving the average gain. Thus, a small antenna device having a wide bandwidth and a high average gain can be obtained. By the hollow groove formed between the chip antenna and the ground portion, the first radiation electrode, the power-supplying electrode and the terminal electrode, etc. of the chip antenna are separate from the ground portion.

The antenna device of the present invention is also suitable as a multi-band antenna device covering pluralities of frequency bands having two or more separate resonance modes. When used for multi-band antenna devices, the chip antenna mounted onto the mounting substrate is combined with the second radiation electrode formed on the chip-antenna-carrying surface or its opposing surface and/or an intermediate layer (when the laminate substrate is used). Namely, second, third, fourth . . . radiation electrodes constituted by linear conductor patterns formed on the chip-antenna-carrying surface, its opposite surface, or the intermediate layer of the multi-layer substrate can be combined with the chip antenna, to make the antenna device adaptable for multi-band. For instance, by adjusting the shape, length, etc. of the first radiation electrode formed on the chip antenna to cause resonance in the first frequency band, and by adjusting the shape, length, etc. of the second radiation electrode formed in a linear conductor pattern on the mounting substrate to cause resonance in the second frequency band, the antenna device is made adaptable for dual-band. However, no isolation is secured between pluralities of frequency bands depending on the arrangement of the first radiation electrode and the second radiation electrode, making it likely that electrostatic coupling increases between the first radiation electrode and the second radiation electrode. This hinders the radiation of an electromagnetic wave from the antenna, resulting in decrease in the gain. The second radiation electrode may be formed on the rear surface of the mounting substrate or on the intermediate layer to secure isolation.

To supply power to the second radiation electrode to utilize two resonance modes, it is necessary to make the open end of the second radiation electrode close to the power-supplying electrode. The first resonance mode is obtained by an LC resonance circuit constituted by the self-inductance of the first radiation electrode, electrostatic capacitance between the first radiation electrode and the ground electrode on the substrate, and electrostatic capacitance between the first radiation electrode and the second radiation electrode. On the other hand, the second resonance mode is obtained by an LC resonance circuit constituted by the self-inductance of the second radiation electrode, electrostatic capacitance between the second radiation electrode and the ground electrode, electrostatic capacitance between the first radiation electrode and the second radiation electrode, and electrostatic capacitance between the open end of the second radiation electrode and the power-supplying electrode. When the open end of the second radiation electrode is close to the power-supplying electrode, two resonance modes are secured. This is also an important feature of the present invention.

A signal supplied from the power-supplying electrode to each resonance circuit having the above structure is resonated in the first and second frequency bands, and part of it is radiated from the antenna into the air. Oppositely, a received signal is converted to voltage via each resonance circuit.

The second radiation electrode may be formed on the chip-antenna-carrying surface or its rear surface. When the second radiation electrode is formed on the rear surface of the substrate, the conductor pattern on the rear surface of the substrate acts as a radiation electrode via the substrate, and thus a geometric distance between the first radiation electrode and the second radiation electrode increases by the substrate thickness, resulting in decrease in electrostatic capacitance between them. This leads to the weakening of coupling accordingly, securing the isolation and increasing the bandwidth. For instance, when a chip antenna of about 3 mm thick is mounted onto a substrate of about 0.6 mm thick (copper-laminated substrate having a relative dielectric constant $\epsilon r$ of 5), the distance between the electrodes providing electrostatic capacitance is 3.6 mm. As a result, coupling between the second radiation electrode and the first radiation electrode is weakened, resulting in further increase in the bandwidth.

When the sub-substrate is provided with the chip antenna and the second radiation electrode, the antenna device can be assembled independently without restricting design on the mounting substrate. In addition, the antenna device of the present invention is free from the influence of noises and electromagnetic waves, because it can be disposed at a separate position from a liquid crystal display, etc. Further, with electromagnetic waves emitted from the antenna separate from a user head, a specific absorption rate SAR, representing the percentage of electromagnetic waves absorbed to the user head, can be drastically reduced.

The antenna device of the present invention comprises the terminal electrode between the first radiation electrode and the second radiation electrode. There may be direct connection or no connection between one end of the first radiation electrode and the terminal electrode, and between the terminal electrode and the second radiation electrode.

In the former case, the first radiation electrode and the terminal electrode are constituted by an integral conductor pattern, and the terminal electrode is connected to the second radiation electrode by soldering, etc. When the second radiation electrode is formed on the rear surface of the substrate, they can easily be connected to each other via a through-hole.

In the latter case, electrostatic capacitance between the radiation electrodes rather increases because of capacitance coupling. In this case, for miniaturization, the capacitance coupling is increased to shorten the radiation electrodes, thereby making the chip antenna smaller. This has the same effect as the formation of a remaining portion on a substrate portion between the open end of the second radiation electrode and the ground portion. As the case may be, the other end of the first radiation electrode is not connected to the power-supplying electrode to achieve capacitance coupling. In this case, by electrostatic capacitance due to the series connection of the power-supplying electrode to the radiation electrode, wide-band impedance matching can be achieved on the power-supplying side. This makes an external matching circuit unnecessary on the power-supplying side of the antenna, thereby simplifying an antenna circuit and reducing power loss. As a result, the efficiency of the entire antenna circuit is improved. Achieving a balance of bandwidth increase, efficiency improvement and miniaturization like this is also a feature of the present invention.

The present invention will be specifically explained below referring to Examples shown in drawings without intention of limiting the present invention thereto.

[1]First Embodiment

FIG. 1 shows an antenna device 80 according to one embodiment of the present invention. A mounting substrate 20 comprises a ground portion 21 having a ground electrode pattern, which comprises a ground portion 21*a* on the chip-antenna-carrying surface, and a ground portion 21*b* formed on the opposing surface (rear surface) of the chip-antenna-carrying surface, and a non-ground portion 22 having no ground electrode pattern, which comprises a non-ground portion 22*a* on the chip-antenna-carrying surface, and a non-ground portion 22*b* on the opposing surface of the chip-antenna-carrying surface. The non-ground portion 22*a* of the mounting substrate 20 is provided with a chip antenna 10, and a second radiation electrode 40 formed in a linear conductor pattern on the surface carrying the chip antenna 10.

Figure 2A:
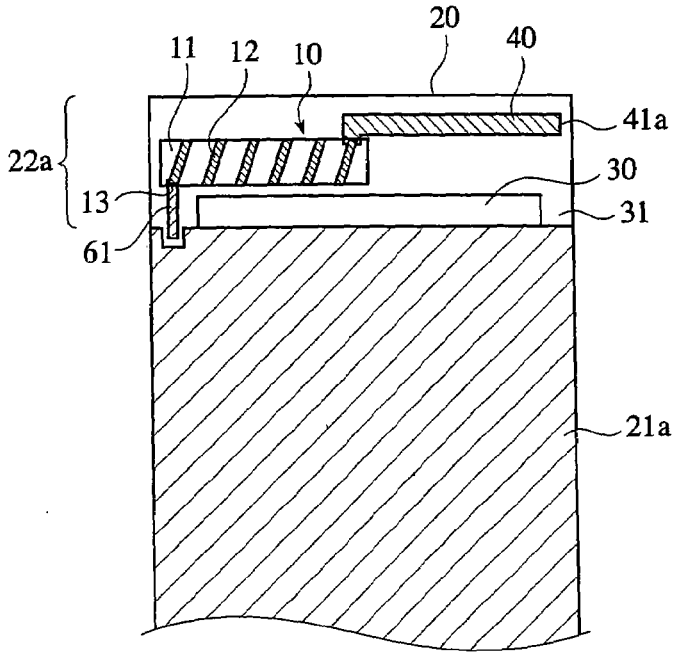
FIG. 2(*a*) is a partial plan view showing one example of the antenna device of the present invention when viewed from the chip-antenna-carrying surface side.
Figure 2B:
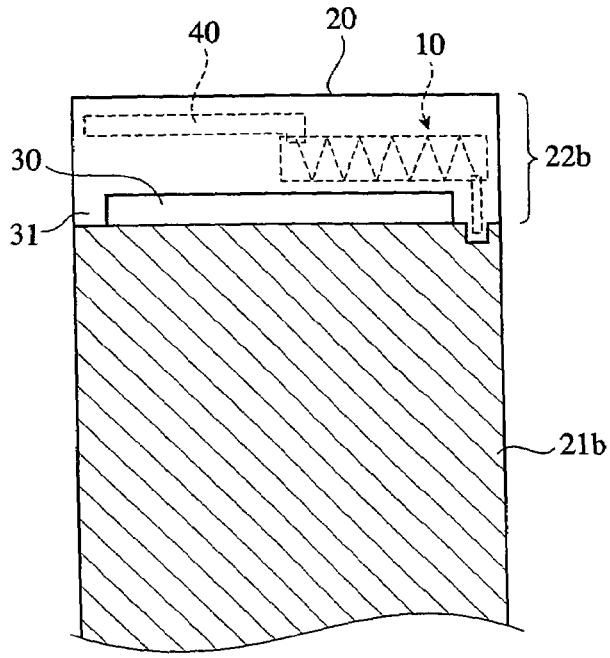

FIG. 2(*a*) is a partial plan view of the antenna device when viewed from the side of the surface carrying the chip antenna 10, and FIG. 2(*b*) is a partial plan view of the antenna device when viewed from the opposite surface (rear surface) of the surface carrying the chip antenna 10. The chip antenna 10 and/or the second radiation electrode 40 are separate from the ground portion 21*a* on the chip-antenna-carrying surface, and from the ground portion 21*b* on the opposing surface (rear surface) of the chip-antenna-carrying surface. Accordingly, there is weak coupling between the chip antenna 10 and/or the second radiation electrode 40 and the ground portions 21*a*, 21*b*, resulting in low Q and a wide bandwidth.

A hollow groove 30 between the chip antenna 10 and/or the second radiation electrode 40 and the ground portions 21*a*, 21*b* further weakens coupling between the chip antenna 10 and/or the second radiation electrode 40 and the ground portion 21*a*, and coupling between the chip antenna 10 and/or the second radiation electrode 40 and the ground portion 21*b*, resulting in a wider bandwidth.

The antenna device 80 shown in FIGS. 1 and 2 is adapted to single-band in a cellular band (800-MHz-band). The series connection of the first radiation electrode 12 on the substrate 11 to the second radiation electrode 40 makes the antenna longer, so that resonance occurs at 800 MHz. Further, the hollow groove 30 increases the bandwidth.

Figure 3A:
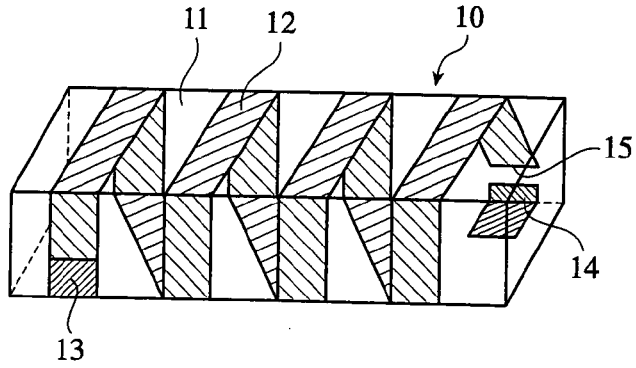
FIG. 3(*a*) is a perspective view showing one example of the chip antenna used in the antenna device of the present invention.
Figure 3B:
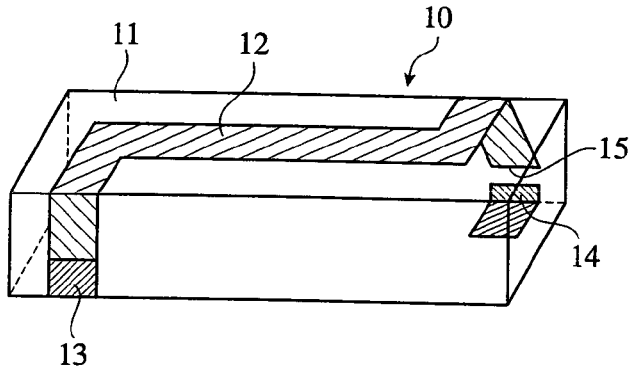
Figure 3C:
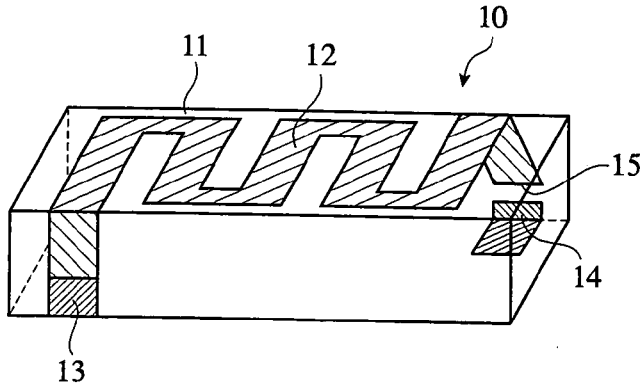

In the case of a single-band antenna device or a dual-band antenna device covering pluralities of relatively close frequency bands by one resonance, a surface-mounted chip antenna is preferable. FIGS. 3(*a*)–(*c*) show the preferred shapes of the first radiation electrode 12 on the chip antenna 10. The first embodiment uses a helical monopole antenna shown in FIG. 3(*a*). This helical monopole antenna comprises a substrate 11, a first radiation electrode 12 formed on the substrate 11 and having an open end 15 at one end, and a power-supplying electrode 13 connected to the other end of the first radiation electrode 12. A terminal electrode 14 usually formed on the side surface of the substrate 11 is used to connect the first radiation electrode 12 formed on the chip antenna 10 to the second radiation electrode 40. In this case, the open end 15 of the first radiation electrode 12 may be directly connected to the terminal electrode 14 by soldering, etc., or they may not be connected for capacitance coupling. Likewise, the terminal electrode 14 and the second radiation electrode 40 may or may not be connected. When they are not connected, capacitance increases, resulting in shortened radiation electrodes. This is also true in embodiments below.

In place of the helical monopole antenna, an L-shaped radiation electrode shown in FIG. 3(*b*), a U-shaped radiation electrode, a crank-shaped radiation electrode, a meandering radiation electrode shown in FIG. 3(*c*), or their combinations may be used. The radiation electrode may be in the shape of a trapezoid, steps, a curved line, etc. In the case of the helical or meandering structure, the radiation electrode is long, adapted to a lower resonance frequency. Combinations with the second radiation electrode make the antenna device adaptable for further lower frequency. The adjustment of the width and length of a linear radiation electrode can easily adjust resonance frequency. Practically, because electrodes referred to as the radiation electrode, the power-supplying electrode and the terminal electrode herein are integrally formed by pattern printing, they are not distinguishable from each other in functions.

Materials for the substrate 11 may be dielectric materials, magnetic materials or their mixtures. When the substrate 11 is made of a dielectric material, the chip antenna 10 can be miniaturized because of a wavelength-decreasing effect. Alumina-based dielectric materials having a relative dielectric constant $\epsilon r$ of 8 are preferable, though not restrictive. The alumina-based dielectric material comprises oxides of Al, Si, Sr and Ti as main components. Specifically, it comprises 10–60% by mass of Al (as $Al_2O_3$), 25–60% by mass of Si (as $SiO_2$), 7.5–50% by mass of Sr (as SrO), and 20% by mass or less of Ti (as $TiO_2$), and may further contain as sub-components at least one of 0.1–10% by mass of Bi (as $Bi_2O_3$), 0.1–5% by mass of Na (as $Na_2O$), 0.1–5% by mass of K (as $K_2O$), and 0.1–5% by mass of Co (as CoO), the total of the main components being 100% by mass.

When the substrate 11 is made of a magnetic material, the chip antenna 10 can be further miniaturized because of large inductance, resulting in smaller Q and a wider bandwidth.

When the substrate 11 is made of a mixture of a dielectric material and a magnetic material, it is possible to achieve the miniaturization of the antenna by the wavelength-decreasing effect, and bandwidth increase by the reduction of the Q of the antenna.

In this embodiment, the size of the substrate 11 may be, for instance, 4 mm wide, 10 mm long, and 3 mm thick.

The impedance matching of the chip antenna 10 can be adjusted by inserting a matching circuit (not shown) between the power-supplying line 61 and the chip antenna 10. Impedance matching can also be achieved by adjusting the width and length of the conductor pattern for the second radiation electrode 40, and the distance between the second radiation electrode 40 and the mounting substrate 20 (substrate thickness), etc.

A linear conductor pattern is preferably formed by printing, though there is no limitation in the width and length of the line. The conductor pattern is not limited to a line, but may be in various shapes such as rectangle, trapezoid, triangle, etc., depending on the characteristics required for the antenna device. The conductor pattern may be formed by a metal sheet, a flexible substrate, etc. In the case of using the metal sheet, the etching step of a copper-laminated substrate can be omitted. In the case of using the flexible substrate, there is a high degree of freedom in mounting design.

In this embodiment, the hollow groove 30 extends over substantially the entire length of the antenna device between the chip antenna 10 and the second radiation electrode 40 and the ground electrode 21 (21*a*, 21*b*). However, the hollow groove 30 may be provided only in a portion in which coupling is relatively strong. Because coupling is strong on the side of the second radiation electrode 40, the hollow groove 30 may be formed only in this region. FIG. 6(*a*) shows a hollow groove 30 constituted by a notch extending from an end of the mounting substrate 20, and FIG. 6(*b*) shows a hollow groove 30 constituted by pluralities of round holes between the chip antenna 10 and the second radiation electrode 40 and the ground portion 21*a*. The hollow groove 30 is not restricted to round holes, but may be penetrating holes of any shapes.

The formation method of the hollow groove 30 is not restrictive, but it may be formed by die-forming, punching, sawing, drilling, etc. For instance, the hollow groove 30 shown in FIG. 1 can be formed by punching, and the hollow groove 30 shown in FIG. 6(*a*) can be formed by sawing, and the hollow groove 30 shown in FIG. 6(*b*) can be formed by drilling.

As the antenna characteristics of the antenna device 80 shown in FIG. 1, a voltage standing wave ratio VSWR was measured in a frequency range of 0.75–0.95 GHz using a signal supplied from a network analyzer, in a case where there was a hollow groove 30 (Example 1), and in a case where there was no hollow groove 30 (Comparative Example 1). VSWR is an index representing the degree of reflection between an antenna and a transmitter (or receiver). In the case of the smallest reflection, VSWR is 1, power supplied from the transmitter being sent to the antenna with no reflection at all. In the largest reflection, on the contrary, VSWR is infinitive, the supplied power being completely reflected, resulting in ineffective electric power.

A power-supplying terminal formed on one end of an antenna-measuring substrate was connected to an input terminal of the network analyzer through a coaxial cable (characteristics impedance: 50Ω), to measure the scattering parameter of the antenna at the power-supplying terminal when viewed from the network analyzer side, and VSWR was calculated from the measured scattering parameter.

Figure 4:
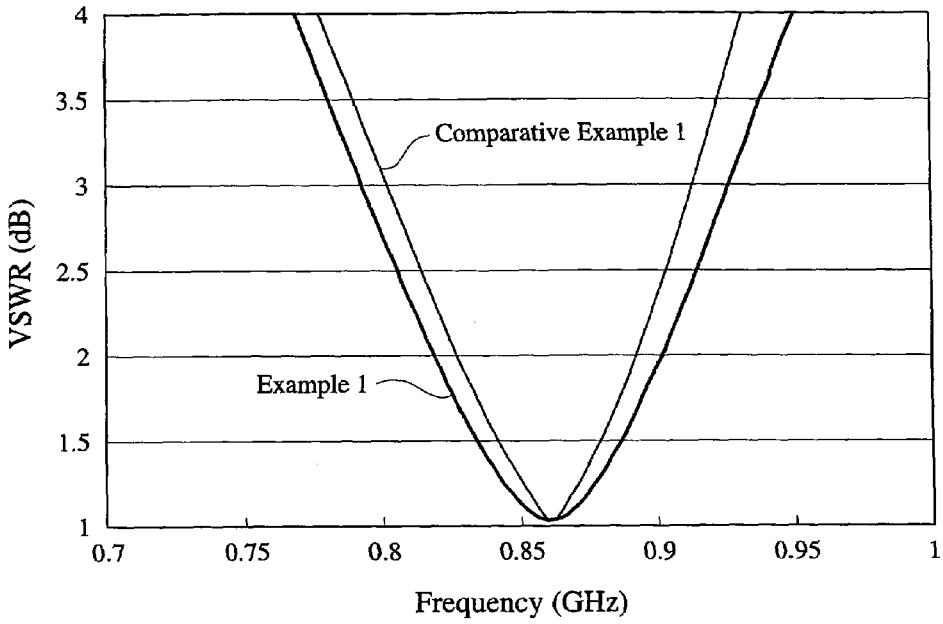
FIG. 4 is a graph showing the relation between a frequency and VSWR in one example of the antenna device of the present invention.

FIG. 4 shows the relation between a frequency and VSWR. The bandwidth was higher by about 15–20% in Example 1 having the hollow groove 30 than in Comparative Example 1 having no hollow groove 30. In Example 1, VSWR was close to 1 in a wide frequency range. The comparison of Example 1 with Comparative Example 1 at VSWR of 2 corresponding to the reflection electric power of about 10% revealed that the bandwidth was wider by about 15–20% in Example 1 than in Comparative Example 1.

Figure 5:
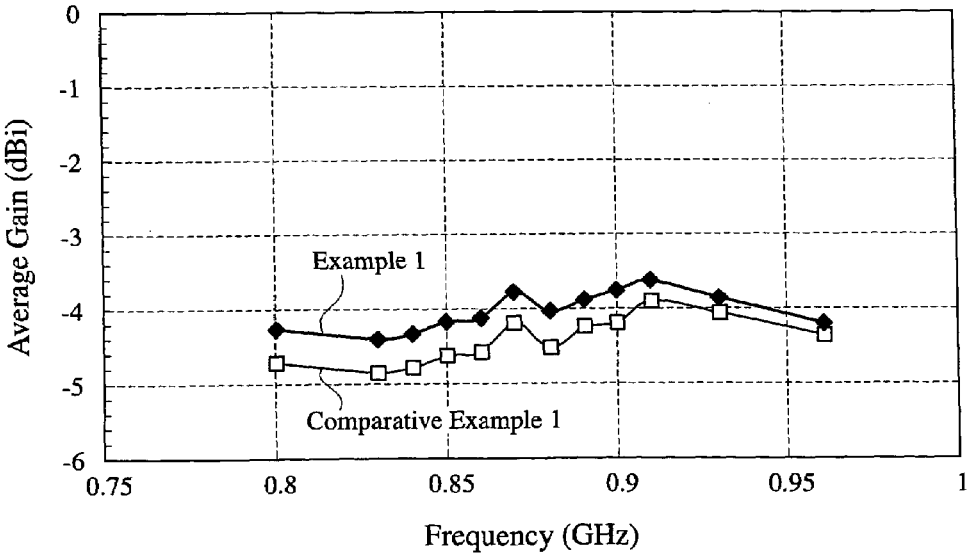
FIG. 5 is a graph showing the relation between a frequency and an average gain in one example of the antenna device of the present invention.

In an anechoic room, the power-supplying terminal 13 (on the transmitting side) of the antenna shown in FIG. 1 was connected to a signal generator, to receive electric power radiated from the antenna by a receiving reference antenna, thereby measuring an average gain. The gain Ga of the test antenna is represented by Ga=Gr×Pa/Pr, wherein Pa is electric power received from the test antenna, Pr is the received electric power measured by a transmitting reference antenna having a known gain Gr. FIG. 5 shows frequency—average gain curves in Example 1 having the hollow groove 30 and Comparative Example 1 having no hollow groove 30. The frequency—average gain curve indicates antenna efficiency. The gain was higher by about 0.5–1 dB in Example 1 than in Comparative Example 1.

It is considered that the higher average gain in Example 1 is due to the fact that even with the same distance between the chip antenna 10 and/or the second radiation electrode 40 and the ground portion 21*a* on the chip-antenna-carrying surface and/or the ground portion 21*b* on the opposing surface (for instance, rear surface) of the chip-antenna-carrying surface, in Example 1 having the hollow groove 30 between the chip antenna 10 and the ground portion 21*a*, not only electrostatic capacitance between them is extremely low, but also little current flows in a direction canceling resonance current each other, so that the radiation of electromagnetic waves is efficiently conducted.

[2]Second Embodiment

Figure 7A:
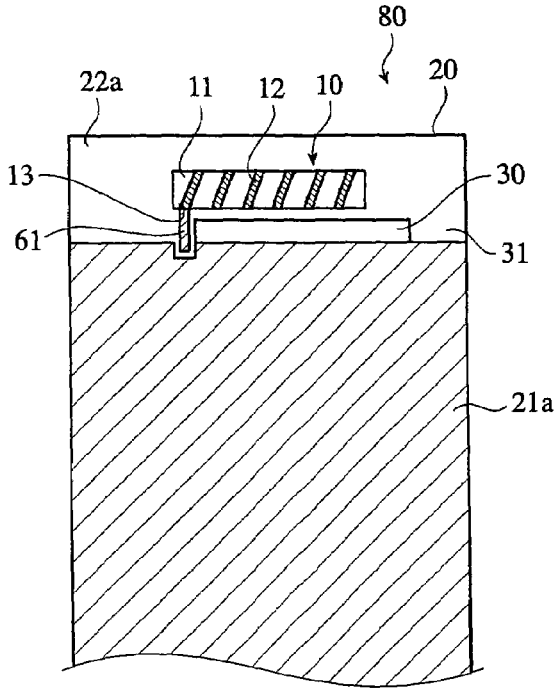
FIG. 7(*a*) is a partial top view showing a still further example of the antenna device of the present invention.
Figure 7B:
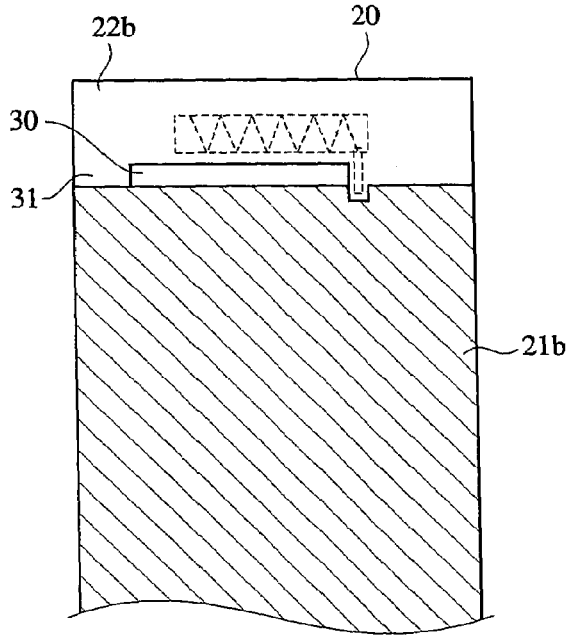

FIG. 7 shows an antenna device according to another embodiment of the present invention, which comprises only a chip antenna 10. This antenna device 80 has a bandwidth increased by a hollow groove 30 provided between the chip antenna 10 and a ground portion 21*a* on a chip-antenna-carrying surface, conducting resonance in as wide a frequency range as 1575–1800 MHz, thereby covering both frequency bands of PCS and GPS. Accordingly, this antenna device 80 is adapted to dual-band. Because the frequency band (1800 MHz) of PCS is relatively close to the frequency band (1575 MHz) of GPS, it is adapted to dual-band with one chip antenna 10. In the present invention, a second radiation electrode is preferably formed, though it may be omitted in some cases, for instance, in an antenna using a single frequency with a narrow bandwidth. Even in such cases, bandwidth increase is obtained by the hollow groove. This is also within the scope of the present invention.

[3]Third Embodiment

Figure 8A:
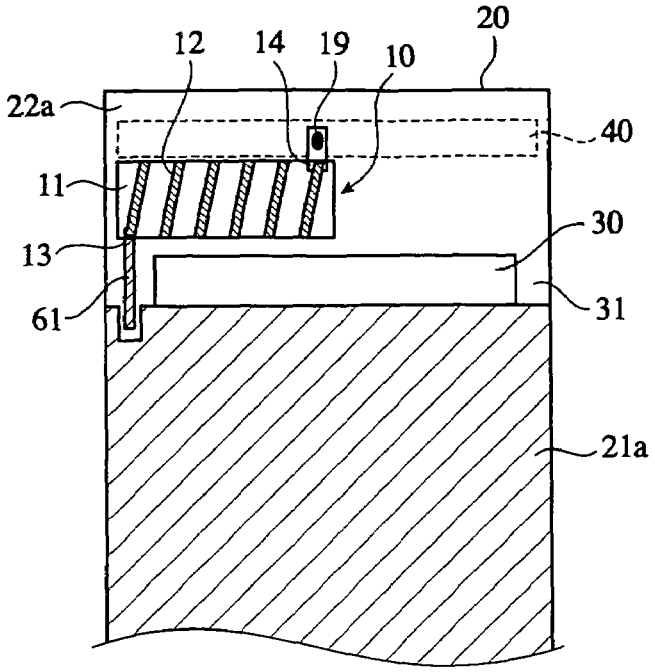
FIG. 8(*a*) is a partial top view showing a still further example of the antenna device of the present invention.
Figure 8B:
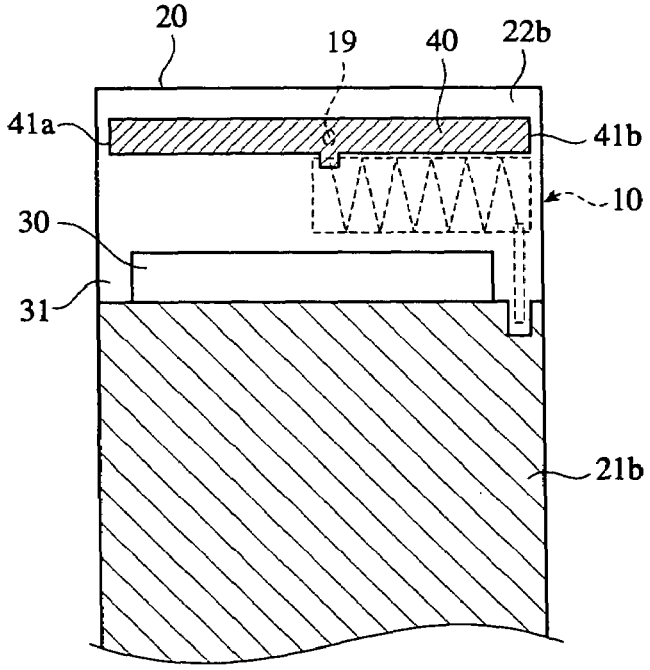

FIG. 8 shows an antenna device, in which a chip antenna 10 is mounted onto one surface of a mounting substrate 20, and a second radiation electrode 40 is formed on the other surface (rear surface) of the mounting substrate 20. In this embodiment, a terminal electrode 14 extends on a surface of the mounting substrate 20, and a first radiation electrode 12 on the chip antenna 10 is connected to the second radiation electrode 40, via a through-hole 19 (depicted by a black circle on the front side and a white circle on the rear side) formed in the mounting substrate 20. This embodiment provides a dual-band antenna device having a cellular band of 800 MHz and a GPS band of 1575 MHz, by interaction between the first radiation electrode 12 and the second radiation electrode 40. On the cellular band side, an open end 41*a* of the second radiation electrode 40 is distant from a power-supplying electrode 13 to increase the effective electric length, thereby making the antenna device adaptable for a low frequency band. On the GPS side, the other open end 41*b* of the second radiation electrode 40 is close to the power-supplying electrode 13 to obtain a resonance mode in a high frequency band. Because the open end 41*b* extends to the power-supplying electrode 13, a resonance mode is obtained in the frequency band of GPS. Because the second radiation electrode 40 is more distant from the ground portion 21 than the chip antenna 10, coupling is low between the second radiation electrode 40 and the ground portions 21*a*, 21*b*. Also, the bandwidth is increased by the hollow groove 30. A wide-band, high-gain antenna device is thus obtained.

In this embodiment, because the chip antenna 10 and the second radiation electrode 40 are opposing each other via the mounting substrate 20, electrostatic capacitance between the chip antenna 10 and the second radiation electrode 40 is decreased by the thickness of the mounting substrate 20. This secures isolation and increases a bandwidth and an antenna gain. To keep a wide band and a high gain by reducing the capacitance coupling, as in this embodiment, the second radiation electrode 40 and the chip antenna 10 are preferably disposed such that they are not overlapping with each other when viewed from above.

Because the second radiation electrode 40 is formed on a surface opposing the surface (front surface) carrying the chip antenna 10, which is, for instance, a rear surface, or an intermediate layer when a multi-layer substrate is used, a mounting space on the front surface can be effectively utilized, contributing to the reduction of the mounting area. Because the size (width and length) of the second radiation electrode 40 can be freely changed, the electrostatic capacitance is also freely changed, thereby easily setting the multi-band center such as the modification of frequency bands, etc. The through-hole 19 makes the connection of the front surface of the substrate to the rear surface easy and simple.

[4]Fourth Embodiment

FIG. 9 shows an antenna device, in which a chip antenna 10 and a second radiation electrode 40 are perpendicularly disposed on the same surface of a mounting substrate 20, and a terminal electrode 14 formed on a side surface of a substrate 11 of the chip antenna 10 is opposing the second radiation electrode 40. This antenna device with such structure can have a longer second radiation electrode 40 than the antenna device shown in FIGS. 1 and 2, thereby having a wider bandwidth in a cellular band of 800-MHz, etc. In this embodiment, a hollow groove 30 is provided only between the second radiation electrode 40 and the ground portions 21*a*, 21*b*. However, because the first radiation electrode 12 of the chip antenna 10 is helical, there is relatively small coupling between the first radiation electrode 12 and the ground portions 21*a*, 21*b*, with little influence on the bandwidth increase. In an arrangement in which the chip antenna 10 is perpendicular to the second radiation electrode 40, because coupling between the ground portions 21*a*, 21*b* and the second radiation electrode 40 is stronger than coupling between the ground portions 21*a*, 21*b* and the first radiation electrode 12 of the chip antenna 10, the position of the hollow groove 30 is preferably on the side of the second radiation electrode 40. This position of the hollow groove 30 is also preferable from the aspect of strength, suitable for substrates disposed in limited space as in mobile phones, portable information terminals, etc.

[5]Fifth Embodiment

Figure 10A:
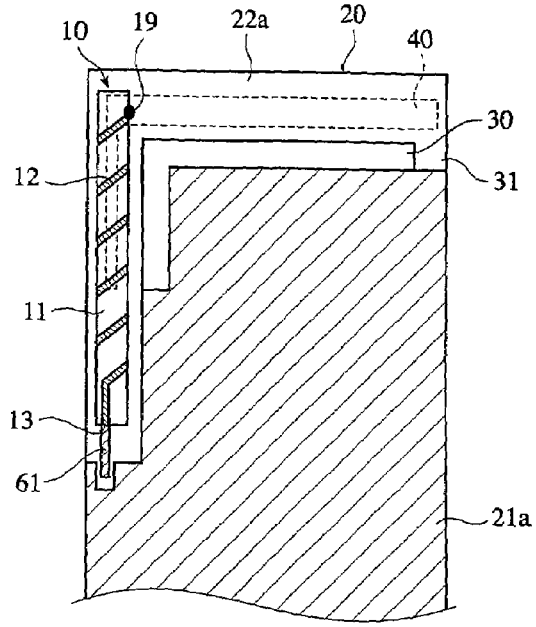
FIG. 10(*a*) is a partial top view showing a still further example of the antenna device of the present invention.
Figure 10B:
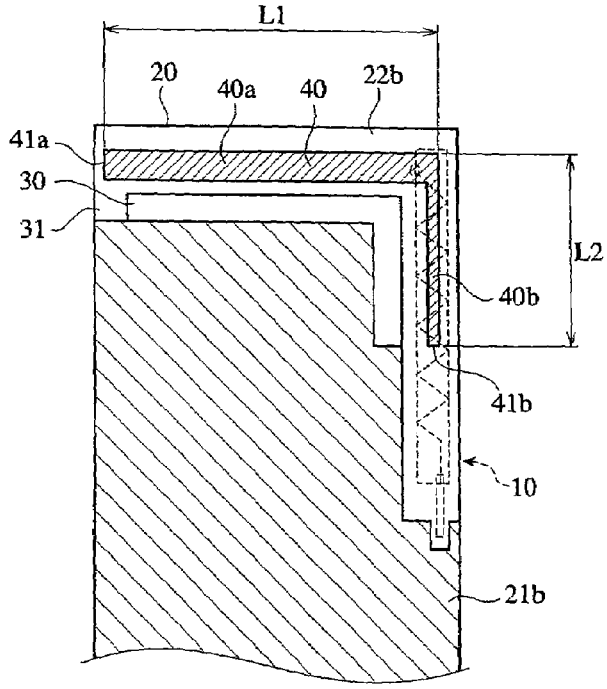

FIG. 10 shows an antenna device, in which a chip antenna 10 on a front surface of a mounting substrate 20 and a second radiation electrode 40 on a rear surface of the mounting substrate 20 are perpendicular to each other, and connected via a through-hole 19. In this embodiment, because the second radiation electrode 40 can be elongated regardless of the position of the chip antenna 10, the second radiation electrode 40 can be in a long L shape constituted by a portion 40*a* perpendicular to the chip antenna 10 and a portion 40*b* in parallel thereto. As a result, this antenna device has such an increased bandwidth that it is adapted to dual-band having a cellular band of 800 MHz and a GPS band of 1575 MHz, etc.

In a multi-band antenna device (resonance frequencies: $f_1$, $f_2$, $f_3$ . . . ) obtained in this embodiment, the pitches of the resonance frequencies can be easily adjusted on the high-frequency side. This will be explained referring to FIG. 10(*b*). The series resonance mode of the portion 40*a* (length: L1) of the second radiation electrode 40 and the chip antenna 10 is a main factor determining a resonance frequency on the low-frequency side, and the series resonance mode of the portion 40*b* (length: L2) of the second radiation electrode 40 and the chip antenna 10 is a main factor determining a resonance frequency on the high-frequency side. Accordingly, a dual-band antenna device having two resonance modes of an 800-MHz band and a 1575-MHz band is obtained. Further, because there is relatively strong coupling between the portion 40*b* of the second radiation electrode 40 and the chip antenna 10, the pitches of resonance frequencies $f_1$, $f_2$ can be adjusted by changing the length L2 of the portion 40*b* of the second radiation electrode 40. For instance, when only the resonance frequency $f_1$ on the low-frequency side is lowered, the portion 40*a* of the second radiation electrode 40 need only be elongated, though the length of the portion 40*a* is limited by the width of the substrate 20. When the first radiation electrode 12 is elongated to lower the resonance frequency $f_1$ on the low-frequency side, the resonance frequency $f_2$ on the high-frequency side is also lowered. Accordingly, by reducing the length of the portion 40*b*, the resonance frequency $f_2$ on the high-frequency side is returned to an original frequency. Thus, by individually adjusting the resonance frequencies of the multi-frequency antenna, the stability and reliability of the communications apparatus are remarkably improved. By changing the number and pitches of winding, the shapes of electrode patterns, etc. in the chip antenna 10, the degree of coupling between the chip antenna 10 and the portion 40*b* of the second radiation electrode 40 can also be changed.

When the second radiation electrode 40 and the chip antenna 10 are disposed such that they are overlapping with each other when viewed from above as in this embodiment, the capacitance coupling is high, while the frequency band is low. Accordingly, the center frequency can be adjusted by changing the degree of such overlap.

The concept that the pitches of resonance frequencies $f_1$, $f_2$, $f_3$ in the multi-band antenna device are adjusted by changing the length of coupling between the chip antenna 10 having the first radiation electrode 12 and the second radiation electrode 40 is not restricted to this embodiment, but may be applied to all the antenna devices in the present invention.

[6]Sixth Embodiment

Figure 11A:
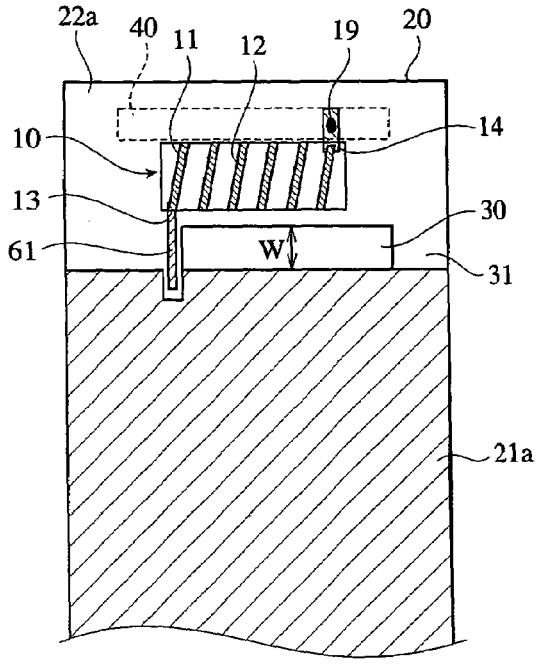
FIG. 11(*a*) is a partial top view showing a still further example of the antenna device of the present invention.
Figure 11B:
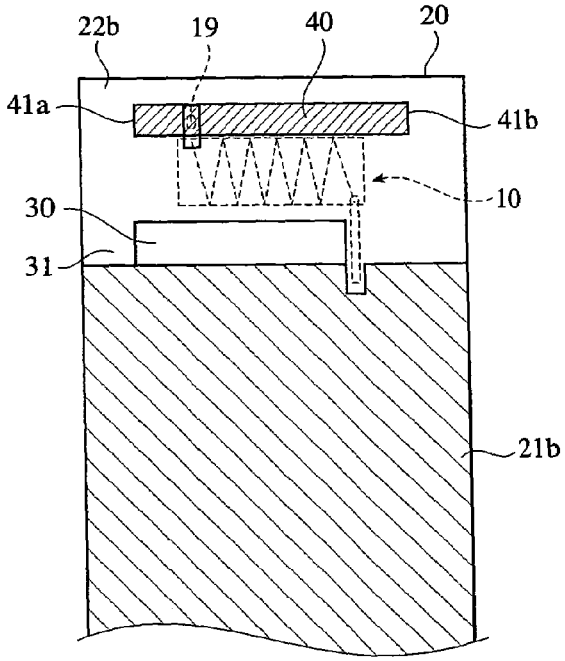

FIG. 11 shows another example of an antenna device, in which a chip antenna 10 is mounted onto a front surface of a mounting substrate 20, and a second radiation electrode 40 is mounted onto a rear surface of the mounting substrate 20. A terminal electrode 14 extending from the chip antenna 10 on a mounting surface of the substrate is connected to the second radiation electrode 40 on the rear surface via a through-hole 19. In this embodiment, because the second radiation electrode 40 and the chip antenna 10 are not overlapping with each other, a high frequency band is obtained. Also, because the second radiation electrode 40 may extend to a position near a power-supplying electrode 13, a second resonance mode is easily obtained. With a high degree of freedom in the shape of both ends of the second radiation electrode 40, the adjustment of resonance frequency is easy.

The change of gain was investigated with the width W of the hollow groove 30 changed to (a) 10 mm (λ/37.5), (b) 6 mm (λ/62.5), and (c) 2 mm (λ/187.5). The resonance frequency of the antenna is 870 MHz (λ=375 mm). The gain was larger in the order of (a)>(b)>(c). However, it is not meaningful to increase the width W of the hollow groove 30 too much for the purpose of increasing the bandwidth, but the width W of the hollow groove 30 is desirably λ/20 or less, particularly λ/10 or less in high-frequency bands for practical applications.

As described above, in this embodiment, in which the second radiation electrode 40 is distant from the ground portion 21, and the hollow groove 30 is provided, further increase in bandwidth and gain can be achieved even in dual-band having a cellular band of 800 MHz and a GPS band of 1575 MHz, etc.

Figure 12:
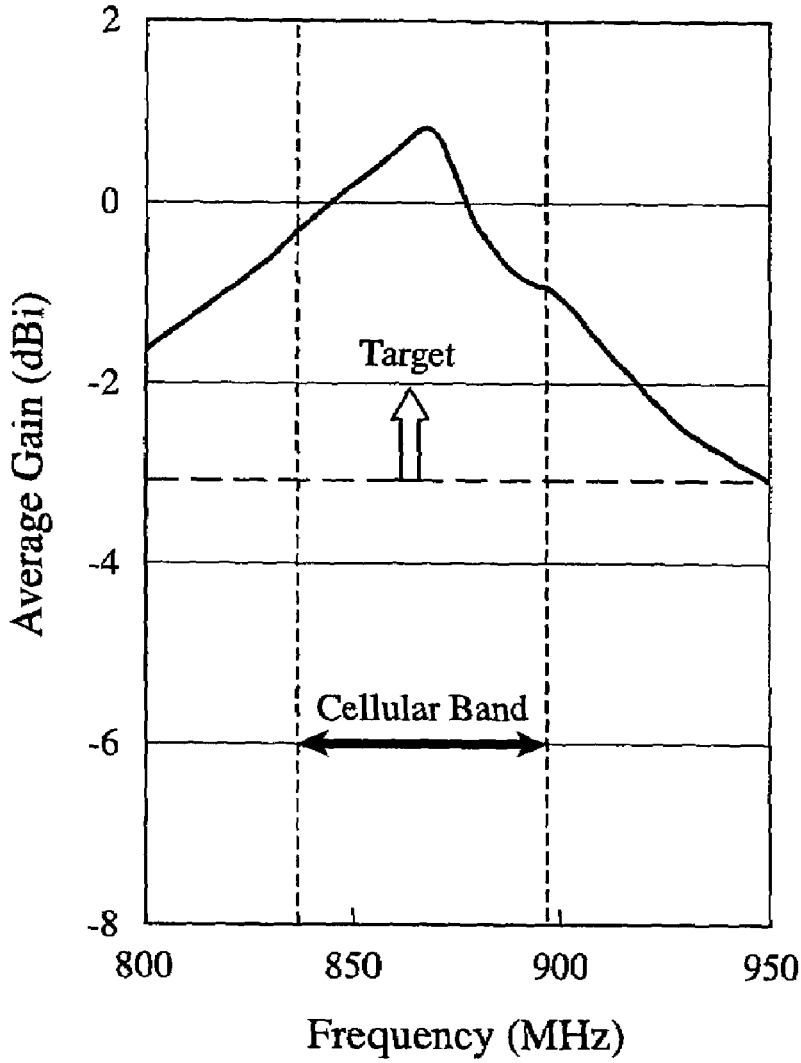
FIG. 12 is a graph showing the relation between a frequency and an average gain in the antenna device of FIG. 11 in a cellular system.
Figure 13:
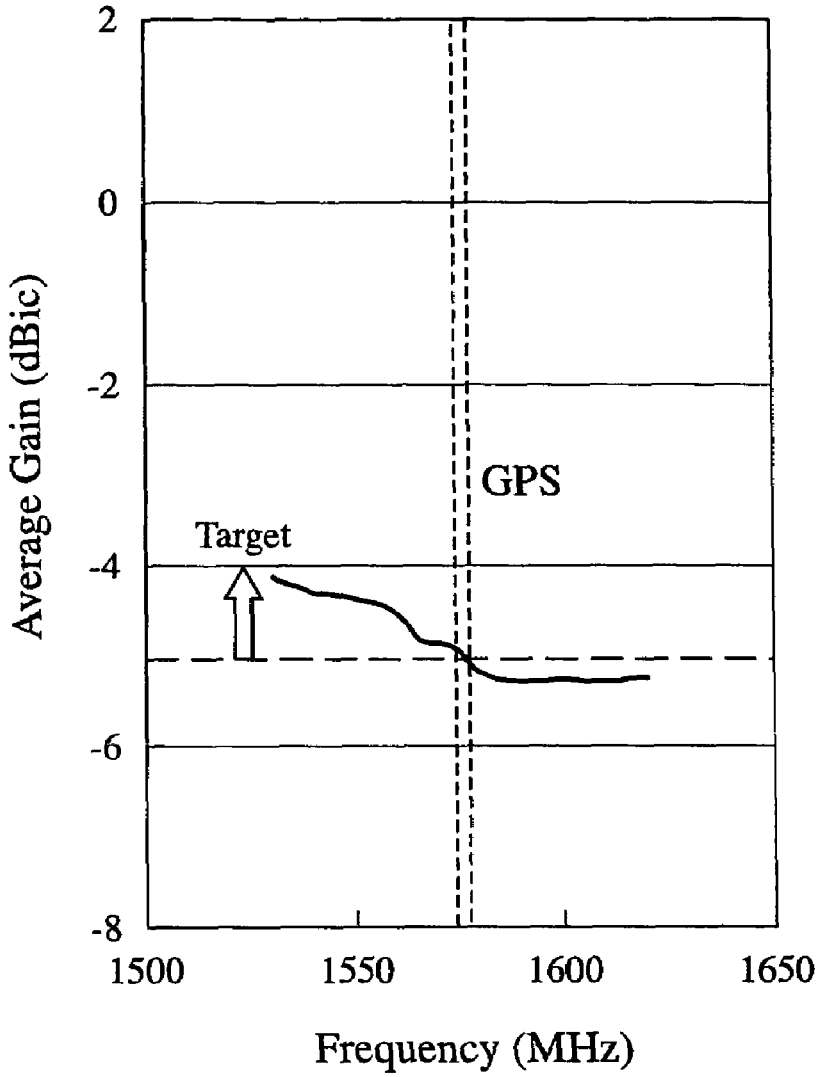
FIG. 13 is a graph showing the relation between a frequency and an average gain in the antenna device of FIG. 11 in a GPS system.

FIGS. 12 and 13 shows gains in the cellular and GPS bands measured on the dual-band antenna in this embodiment with a hollow groove having a width W of 10 mm. In both cases, high gain meeting the target was obtained in the specification of communications frequency bands. Particularly in the cellular band shown in FIG. 12, the average gain at a center frequency of 870 MHz was +1 dBi at maximum and −1 dBi at minimum, on the same level or more of conventional Whip-type antennas.

[7]Seventh Embodiment

Figure 14A:
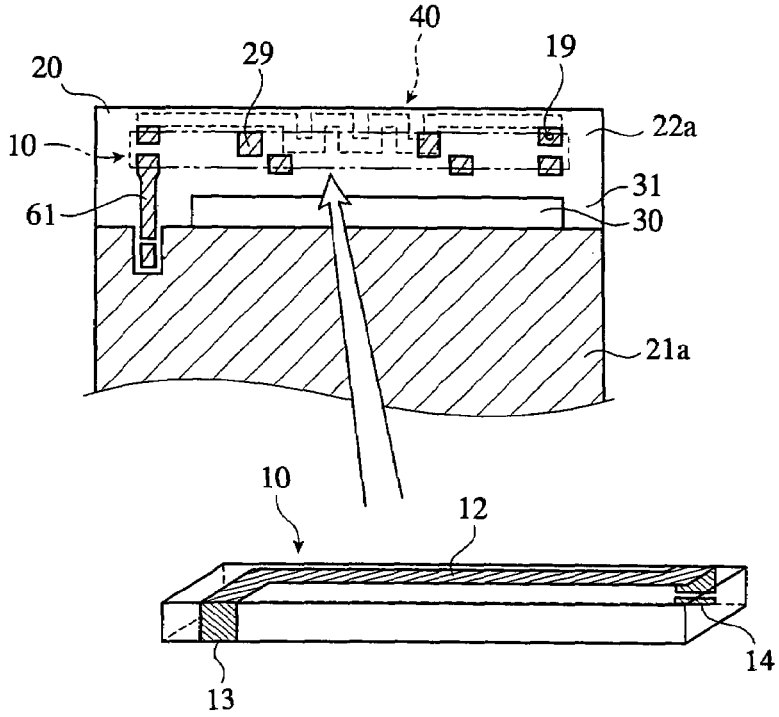
FIG. 14(*a*) is a partial plan view showing a still further example of the antenna device of the present invention.
Figure 14B:
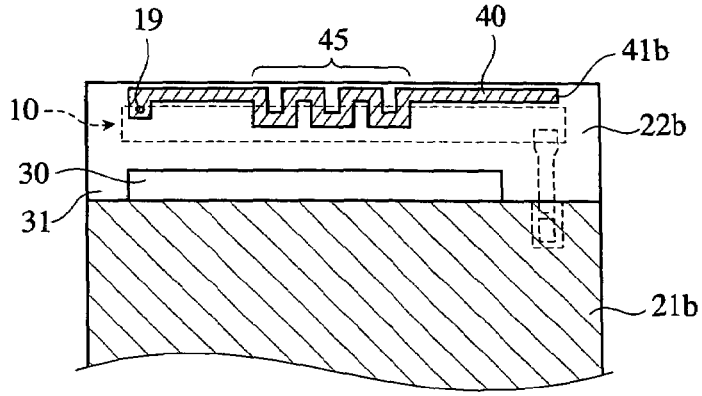

FIGS. 14(*a*) and 14(*b*) show an antenna device, in which a chip antenna 10 is mounted onto a front surface of a mounting substrate 20, and a second radiation electrode 40 is formed on a rear surface of the mounting substrate 20. An electrode 29 is for soldering the chip antenna 10. The antenna device in this embodiment has the same basic structure as those of the above antenna devices, except that the second radiation electrode 40 has a long, meandering center portion 45. The second radiation electrode 40 may easily be formed by screen printing, etc. on the substrate 20.

[8]Eighth Embodiment

Figure 15A:
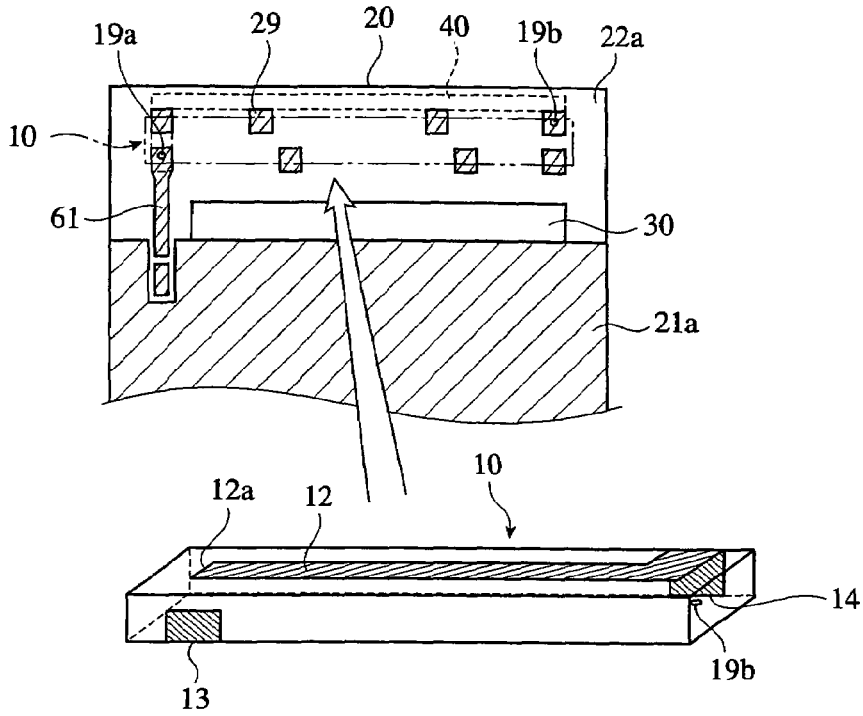
FIG. 15(*a*) is a partial plan view showing a still further example of the antenna device of the present invention.
Figure 15B:
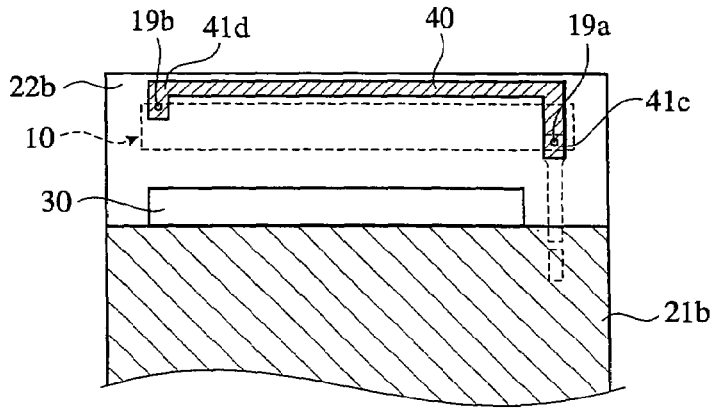

FIGS. 15(*a*) and 15(*b*) show a further example of an antenna device, in which a chip antenna 10 is mounted onto a front surface of a mounting substrate 20, and a second radiation electrode 40 is formed on a rear surface of the mounting substrate 20. A power-supplying electrode 13 connected to a power-supplying line 61 is connected to one end 41*c* of the second radiation electrode 40 formed on a rear surface of the mounting substrate 20 via through-hole 19*a*, and a conductor pattern of the second radiation electrode 40 extends to the other end 41*d* on the rear surface of the mounting substrate, and then is connected to a terminal electrode 14 of the chip antenna 10 on the front surface of the mounting substrate via a through-hole 19*b*. The terminal electrode 14 is connected to the first radiation electrode 12, which extends to an open end 12*a* on a top surface of the substrate 11 through its side surface. In this embodiment, the open end 12*a* of the first radiation electrode 12 formed on the chip antenna 10 is not connected to the power-supplying electrode 13, providing capacitance coupling. The other structure of the antenna device in this embodiment may be substantially the same as those of the above embodiments. The antenna device having such structure in this embodiment can also provide the same effects as those of the antenna devices in the above embodiments.

[9]Ninth Embodiment

FIGS. 16(*a*)14 (*c*) show an antenna device comprising a sub-substrate 25 in addition to the mounting substrate 20, a chip antenna 10 being mounted onto the sub-substrate 25. The sub-substrate 25 comprises a front non-ground portion 25*a* and rear non-ground portion 25*b*, and a chip antenna 10 is mounted onto a front surface of the sub-substrate 25. A second radiation electrode 40 is formed on a rear surface 25*b* of the sub-substrate 25. One end of the first radiation electrode 12 is connected to the terminal electrode 14, and the terminal electrode 14 is connected to the second radiation electrode 40 via a through-hole 19*b*. A power-supplying electrode 13 is connected to a power-supplying line 61*a* on the sub-substrate 25, which is connected to a power-supplying pin 65 vertically extending from the mounting substrate 20 via a through-hole 19*a*. The power-supplying pin 65 is connected to a power-supplying line 61*b*, which is connected to a power-supplying source 62. The sub-substrate 25 is supported by pillars 66, tables, etc. such that it is separate from the mounting substrate 20, thereby providing a cavity (space) 35 between the second radiation electrode 40 and the ground portion 21*a* on the mounting substrate 20. The cavity 35 acts to increase bandwidth like the above hollow groove 30.

Figure 20:
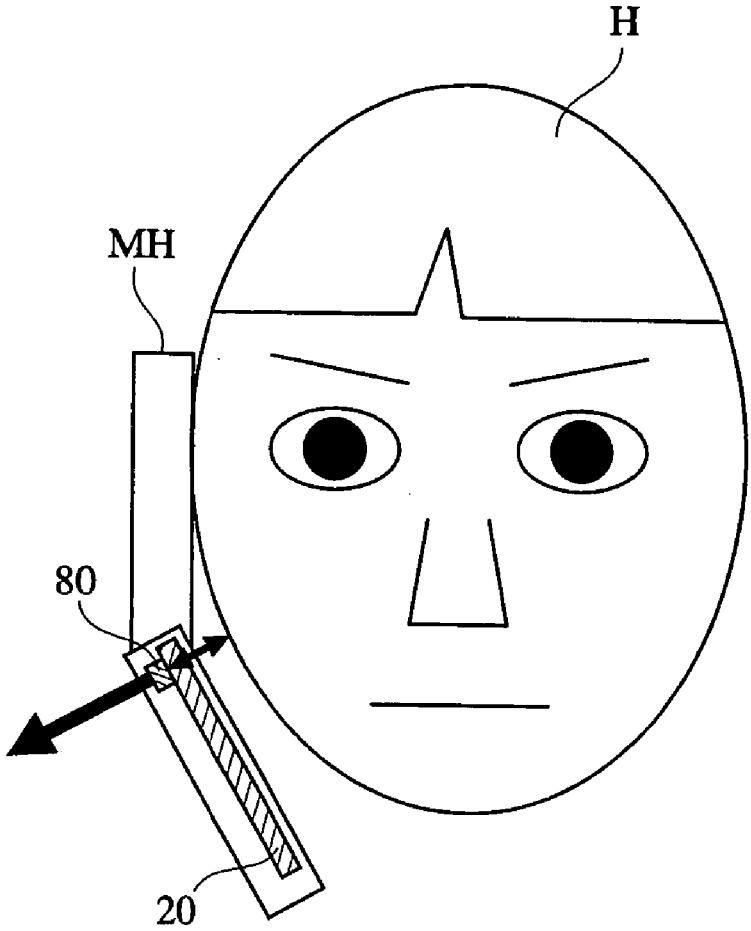
FIG. 20 is a schematic view showing that an electromagnetic wave is absorbed by a human head when a mobile phone comprising the antenna device of the present invention is used.

In a foldable mobile phone, an antenna-mounting substrate is disposed on a rear side of a liquid crystal display or a keyboard in many cases (see FIG. 20). When the sub-substrate 25 carrying the chip antenna 10 is separate from the mounting substrate 20 such that it is further distant from a liquid crystal display, etc. as in this embodiment, it is little influenced by noises from the liquid crystal display, etc., thereby being effective for improving the gain. Such arrangement also places the chip antenna 10 distant from a user head, providing the reduction of SAR. Further, because of the structure of fixing the sub-substrate 25 to the mounting substrate 20, the production of parts each having a chip antenna 10 mounted onto a sub-substrate 25, and the assembling of each part in a mounting substrate 20 can be performed by separate steps, resulting in improved production efficiency and parts management. It is also convenient for the exchange and maintenance of parts.

Figure 17A:
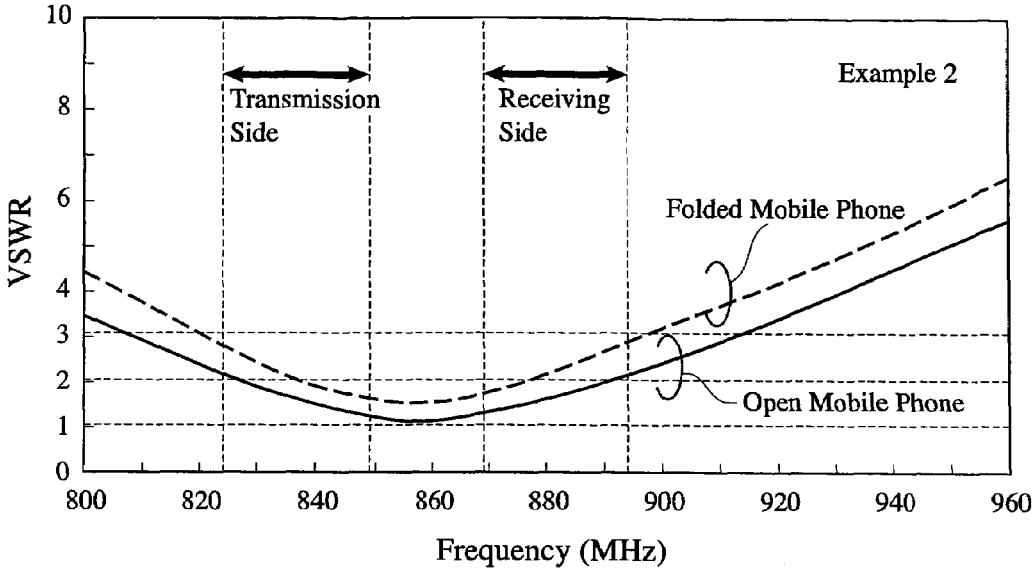
FIG. 17(*a*) is a graph showing the relation between a frequency and VSWR in the antenna device of Example 2.
Figure 17B:
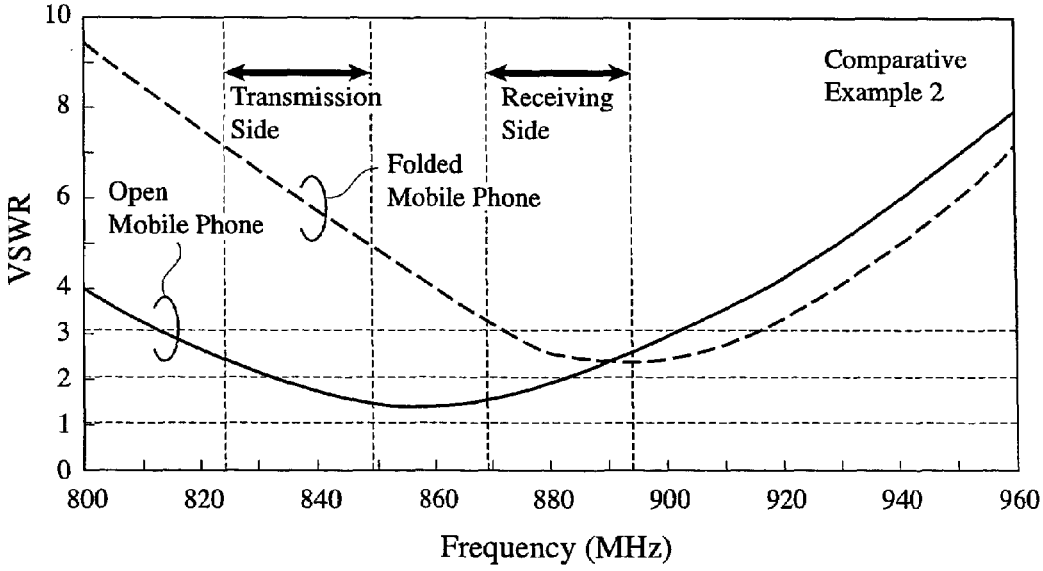

The antenna characteristics of the antenna device shown in FIG. 16 were measured when used in a foldable mobile phone (Example 2). The relation between a frequency and VSWR was measured in a frequency range of 800 to 960 MHz using a signal supplied from a network analyzer in the same manner as above. The results are shown in FIG. 17(*a*). For comparison, FIG. 17(*b*) shows the relation between a frequency and VSWR in a case where only a chip antenna is mounted onto a substrate without a hollow groove (Comparative Example 2). In each graph, a solid line represents data when the mobile phone was open, and a dotted line represents data when the mobile phone was folded.

The antenna device of Example 2 had a wide band with small difference in the antenna characteristics between when the mobile phone was open and when the mobile phone was folded. That is, when the mobile phone was open, VSWR was as good as nearly 1 in a wide frequency range. The bandwidth was wider by about 15–20% in Example 2 than in Comparative Example 2 at VSWR of 2 corresponding to the reflection electric power of about 10%. The antenna device of Example 2 was stable even when the mobile phone was folded, exhibiting VSWR of 2 or less in a wide band, and VSWR of 3 or less almost in the entire band range.

Figure 18A:
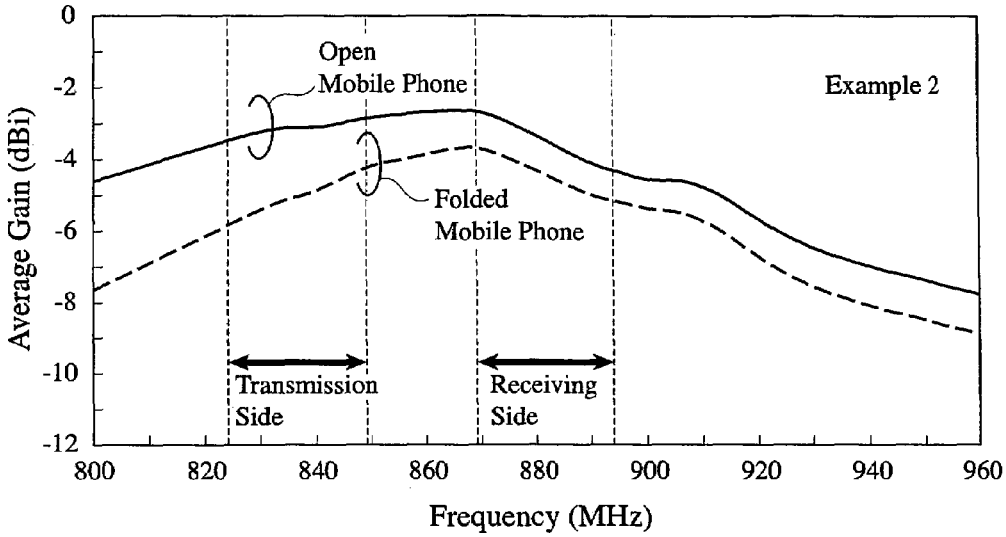
FIG. 18(*a*) is a graph showing the relation between a frequency and an average gain in the antenna device of Example 2.
Figure 18B:
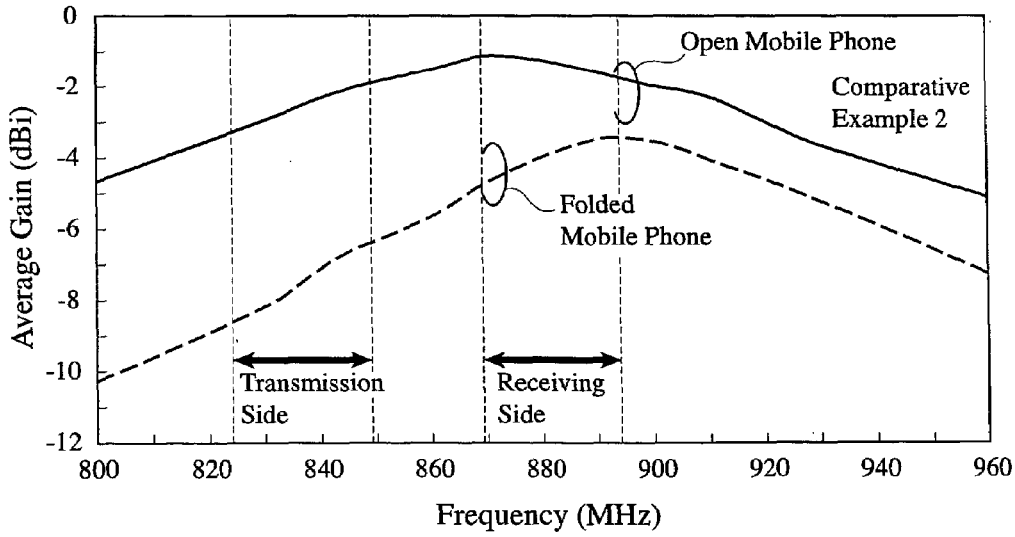

FIGS. 18(*a*) and 18(*b*) show the relation between a frequency and an average gain in Example 2 and Comparative Example 2, respectively. The measurement methods are the same as described above. As is clear from FIG. 18, the gain of the antenna device in the folded mobile phone of Example 2 was improved by about 2 to 3 db in the entire band range. Though the gain was low in the transmission band in Comparative Example 2, it was high in both transmission and receiving bands in Example 2. When the mobile phone was open, the average gain was sufficient. The use of the sub-substrate provides an antenna device with substantially equal characteristics regardless of whether or not the mobile phone is open or folded.

[10]Tenth Embodiment

Figure 19:
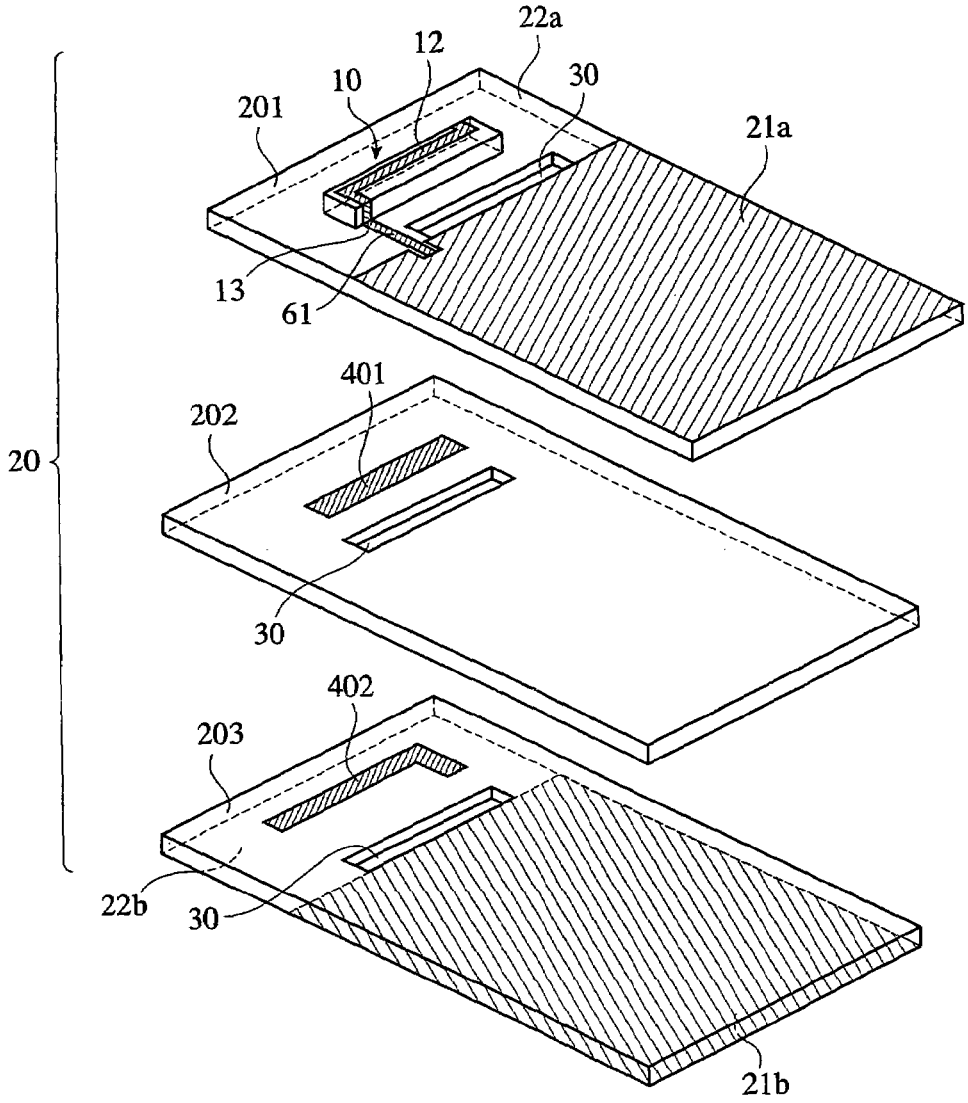
FIG. 19 is a development view showing laminate substrates constituting the antenna device of the present invention.

FIG. 19 shows an antenna device having a mounting substrate 20 in a laminate structure. The mounting substrate 20 has a laminate structure comprising a first layer 201, a second layer 202 and a third layer 203, a chip antenna 10 being mounted onto a non-ground portion 22*a* of the first layer 201, a second radiation electrode 401 being printed on the second layer 202, a third radiation electrode 402 being printed on a rear surface of the third layer 203, and a first radiation electrode 12 on the chip antenna 10 being connected to the second and third radiation electrodes 401, 402 via through-holes (not shown). With these radiation electrodes, the antenna device can be adapted to triple-band. In this embodiment, the first radiation electrode 12 of the chip antenna 10 has a crank shape as shown in FIG. 3(*b*), and a hollow groove 30 is formed in all the layers 201–203 between the chip antenna 10 and the ground portions 21*a*, 21*b*. The second layer 202 may or may not have a ground electrode.

Figure 21:
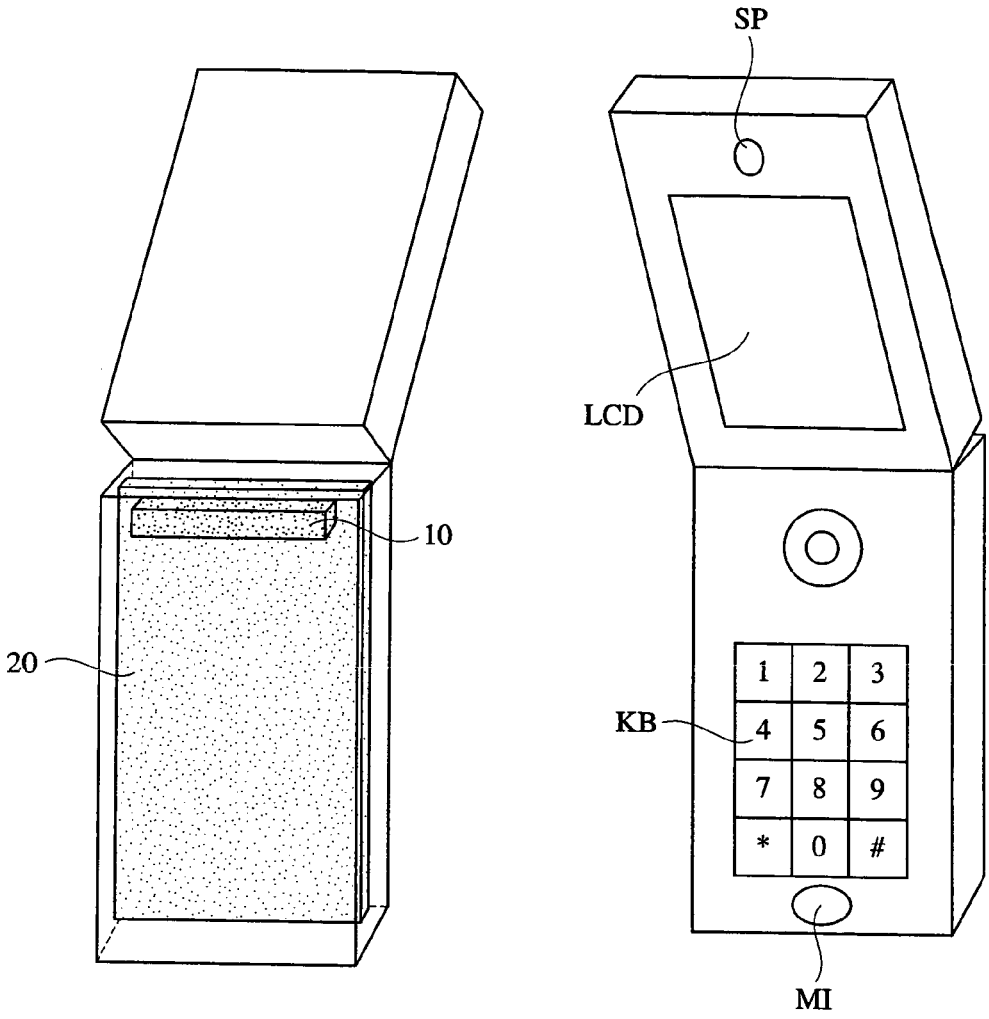
FIG. 21 is a schematic view showing one example of a mobile phone comprising the antenna device of the present invention.

FIG. 20 shows an example, in which the antenna device 80 is mounted onto a main substrate (on the keyboard side) 20 of a mobile phone MH. Because the chip antenna 10 is small, it may be mounted near a liquid crystal display LCD, a speaker SP or a microphone MI as shown in FIG. 21. In a state where the mobile phone is close to a user head H as shown in FIG. 18, part of electromagnetic waves radiated from the mobile phone are absorbed by a human body. The absorption of electromagnetic waves by the head H weakens those radiated toward the head H, resulting in low gain. In addition, much attention is recently paid to the adverse effect of absorbed electromagnetic waves on health, providing legal regulations on the specific absorption rate SAR.

To prevent the gain from decreasing by the absorption of electromagnetic waves to a human body, and to reduce SAR, it is effective to separate an electric field generated from the chip antenna from a user head H as much as possible. In the present invention, the chip antenna can preferably be mounted onto a surface of a main substrate on the opposite side of the user head H. Particularly, when the chip antenna 10 is mounted onto the sub-substrate 25 separate from the mounting substrate 20 as in the ninth embodiment, the distance between the chip antenna 10 and the liquid crystal display LCD is desirably further increased. Also, the mounting of the chip antenna 10 in a center portion or near a microphone MI on the side of a keyboard KB in a mobile phone body as shown in FIG. 21 is desirable not only for the reduction of noises generated from the liquid crystal display LCD but also for the reduction of SAR.

Figure 22A:
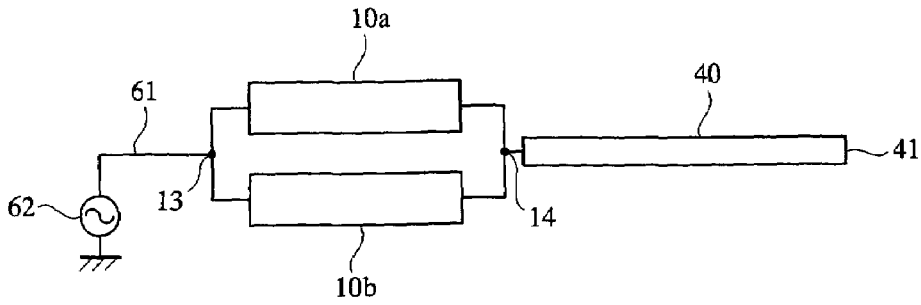
FIG. 22(*a*) is a block diagram showing one example of the antenna device of the present invention.
Figure 22B:
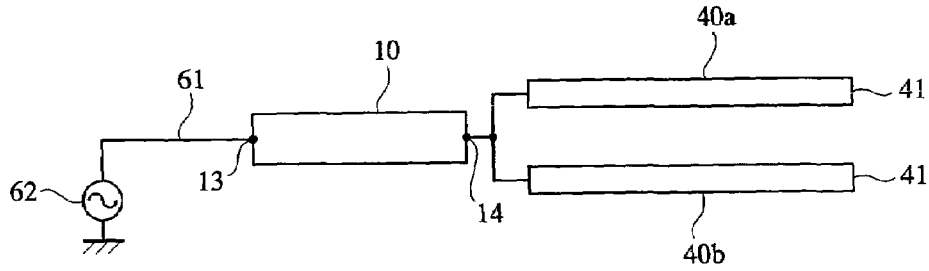
Figure 23:
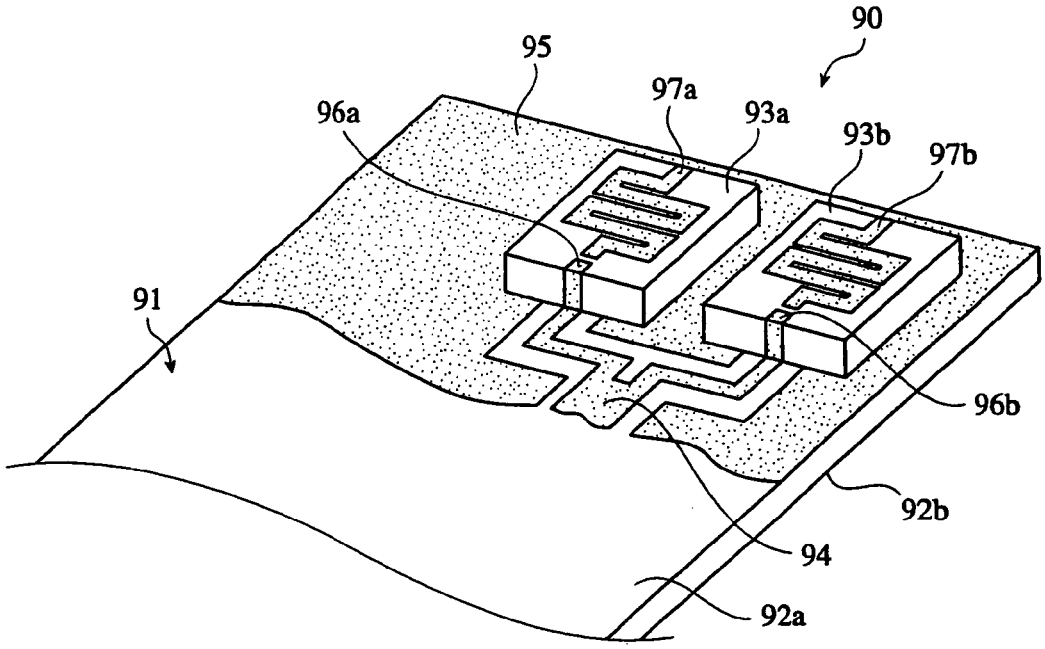
Fig. 23 (PRIOR ART)
FIG. 23 is a perspective view showing one example of conventional antenna devices.

Though the antenna device of the present invention has been explained referring to the drawings, it is not restricted thereto, and various modifications may be added, if necessary, within the concept of the present invention. FIG. 22 is a block diagram showing other examples of the antenna device 80 of the present invention. In the antenna device shown in FIG. 22(*a*), a high-frequency signal source 62 is connected to parallel chip antennas 10*a*, 10*b* via a power-supplying line 61 and a power-supplying electrode 13, and a terminal electrode 14 of the chip antennas 10*a*, 10*b* on the opposite side of the power-supplying electrode 13 is connected to a second radiation electrode 40. In the antenna device shown in FIG. 22(*b*), a high-frequency signal source 62 is connected to a chip antenna 10 via a power-supplying line 61 and a power-supplying electrode 13, and a terminal electrode 14 of the chip antenna 10 on opposite side of the power-supplying electrode 13 is connected to two parallel second radiation electrodes 40*a*, 40*b*. The antenna device with such structure can be mounted onto the mounting substrate as in the above embodiments.

As described above, because the antenna device of the present invention has a wide bandwidth due to the second radiation electrode, it may be used not only for mobile phones, but also for all wireless communications apparatuses such as mobile terminals, personal computers, GPS equipments mounted in automobiles, wireless LANs, etc. The wide-bandwidth antenna device is easily adapted not only to a single-band but also to multi-band. For instance, it may be used for mobile phones of GSM (0.9 GHz)+GPS+PCS (1.8 GHz)+DCS (1.9 GHz), cellular (0.8 GHz)+PCS (1.9 GHz)+GPS (1.5 GHz)+ . . . , etc., and communications apparatuses such as wireless LANs of wide-band CDMA (code division multiple access) (2-GHz band), 802.11a (5-GHz band)+802.11b (2.4 GHz), etc.

The hollow groove between the chip antenna and/or the second radiation electrode and the ground portion of the mounting substrate makes their capacitance coupling smaller. The formation of the second radiation electrode on the opposing surface (rear surface) of the mounting substrate, or on an intermediate layer, etc. further increases the distance between the second radiation electrode and the ground portion, thereby further decreasing their capacitance coupling. With these structures, the Q value is small, the isolation is kept, and the resonance current loss is reduced. As a result, the antenna device having a wide bandwidth and a high gain can be obtained.

In the antenna device having a second radiation electrode formed on a surface of a mounting substrate different from a chip-antenna-carrying surface, a substrate space can be effectively used, achieving further miniaturization.

Further, because a radiation electrode can be formed not only on an antenna substrate but also on a front or rear surface of a mounting substrate, or on an intermediate layer, etc. separately in the antenna device of the present invention, it is possible to avoid an electric field distribution from concentrating in a user head. As a result, the absorption of electromagnetic waves radiated from a mobile phone in a user head is reduced, and the SAR is reduced.

The antenna device of the present invention having the above features provides a small communications apparatus with a small SAR, which is adapted to multi-band such as dual-band, triple-band, etc.

What is claimed is:

1. An antenna device, comprising:

(a) a mounting substrate having a ground portion and a non-ground portion;

(b) a chip antenna mounted onto said non-ground portion, which comprises a substrate, a first radiation electrode formed on said substrate, a power-supplying electrode connected by direct connection to or capacitance coupling with the other end of said first radiation electrode, and a terminal electrode connected by direct connection to or capacitance coupling with one end of said first radiation electrode; and (c) at least one second radiation electrode formed in a conductor pattern on said non-ground portion, said second radiation electrode having one end connected by direct connection to or capacitance coupling with said terminal electrode and the other end which is an open end, and a cavity existing between said chip antenna and/or said second radiation electrode and said ground portion of said mounting substrate.

2. The antenna device according to claim 1, wherein said second radiation electrode is formed such that its open end is distant from said power-supplying electrode.

3. The antenna device according to claim 1, wherein said second radiation electrode is formed such that its open end is near said power-supplying electrode.

4. The antenna device according to claim 1, wherein said second radiation electrode is formed such that it has one open end distant from said power-supplying electrode and the other open end near said power-supplying electrode.

5. The antenna device according to claim 1, wherein a remaining portion of the said substrate obtained by the formation of said cavity is on the side of the open end of said second radiation electrode.

6. A communications apparatus comprising the antenna device recited in claim 1.

7. An antenna device, comprising:

(a) a mounting substrate having a ground portion and a non-ground portion;

(b) a chip antenna mounted onto said non-ground portion, which comprises a substrate, a first radiation electrode formed on said substrate, a power-supplying electrode connected by direct connection to or capacitance coupling with the other end of said first radiation electrode, and a terminal electrode connected by direct connection to or capacitance coupling with one end of said first radiation electrode; and (c) at least one second radiation electrode formed in a conductor pattern on a non-ground portion, which is an opposing surface of the chip-antenna-carrying surface of said mounting substrate, said second radiation electrode being connected by direct connection to or capacitance coupling with said terminal electrode, with its other end being an open end, and a cavity existing between said chip antenna and/or said second radiation electrode and said ground portion of said mounting substrate.

8. The antenna device according to claim 7, wherein said terminal electrode is connected to said second radiation electrode via a through-hole.

9. The antenna device according to claim 7, wherein said second radiation electrode is formed such that its open end is distant from said power-supplying electrode.

10. The antenna device according to claim 7, wherein said second radiation electrode is formed such that its open end is near said power-supplying electrode.

11. The antenna device according to claim 7, wherein said second radiation electrode is formed such that its one open end is distant from said power-supplying electrode, and that its other open end is near said power-supplying electrode.

12. The antenna device according to claim 7, wherein a remaining portion of the said substrate obtained by the formation of said cavity is on the side of the open end of said second radiation electrode.

13. The antenna device according to claim 7, wherein said chip antenna and said second radiation electrode formed on the opposing surface of the chip-antenna-carrying surface are disposed such that they are not overlapping with each other when viewed from above.

14. The antenna device according to claim 7, wherein said chip antenna and said second radiation electrode formed on the opposing surface of the chip-antenna-carrying surface are disposed such that they are overlapping with each other when viewed from above.

15. A communications apparatus comprising the antenna device recited in claim 7.

16. An antenna device, comprising:

(a) a mounting substrate having a ground portion and a non-ground portion;

(b) a sub-substrate fixed to said mounting substrate with space;

(c) a chip antenna mounted onto said sub-substrate, which comprises a substrate, a first radiation electrode formed on said substrate, a power-supplying electrode connected by direct connection to or capacitance coupling with the other end of said first radiation electrode, and a terminal electrode connected by direct connection to or capacitance coupling with one end of said first radiation electrode; and (d) at least one second radiation electrode formed in a conductor pattern on the chip-antenna-carrying surface of said sub-substrate or its opposing surface, said second radiation electrode being connected by direct connection to or capacitance coupling with said terminal electrode, with its other end being an open end, and a cavity existing between said chip antenna and/or said second radiation electrode and the ground portion of said mounting substrate.

17. The antenna device according to claim 16, wherein the terminal electrode of said chip antenna is connected to said second radiation electrode on the opposing surface of the chip-antenna-carrying surface via a through-hole.

18. The antenna device according to claim 16, wherein said chip antenna and said second radiation electrode formed on the opposing surface of the chip-antenna-carrying surface are disposed such that they are not overlapping with each other when viewed from above.

19. The antenna device according to claim 16, wherein said chip antenna and said second radiation electrode formed on the opposing surface of the chip-antenna-carrying surface are disposed such that they are overlapping with each other when viewed from above.

20. A communications apparatus comprising the antenna device recited in claim 16.

* * * * *

UNITED STATES PATENT AND TRADEMARK OFFICE

CERTIFICATE OF CORRECTION

PATENT NO. : 7,148,851 B2 
APPLICATION NO. : 10/912282
DATED : December 12, 2006
INVENTOR(S) : Yasunori Takaki and Hiroyuki Aoyama It is certified that error appears in the above-identified patent and that said Letters Patent is hereby corrected as shown below:

On the Title Page, Item (57), in the Abstract, line 1, “comprising” should read --including--;

lines 3-4, “comprises” should read --includes--;

lines 5-6, “or not connected to” should read --by direct connection to or capicitance coupling with--;

line 7, “or not connected to” should read --by direct connection to or capicitance coupling with--; and line 11, “or not connected to” should read --by direct connection to or capicitance coupling with--.

Signed and Sealed this

Twenty-seventh Day of February, 2007

JON W. DUDAS
*Director of the United States Patent and Trademark Office*